US010760303B2

(12) United States Patent
Zeus et al.

(10) Patent No.: US 10,760,303 B2
(45) Date of Patent: Sep. 1, 2020

(54) MULTI-POINT LOCK WITH SINGLE ACTUATION AND MISHANDLING DEVICE AND SELF-ALIGNING ENGAGEMENT

(71) Applicants: Christian Josef Stephan Zeus, Stilfs (IT); Oliver Erich Rudolf Schuberth, Laas (IT); Matthew T. Taylor, Milton, WI (US)

(72) Inventors: Christian Josef Stephan Zeus, Stilfs (IT); Oliver Erich Rudolf Schuberth, Laas (IT); Matthew T. Taylor, Milton, WI (US)

(73) Assignee: Hoppe Holding AG, Müstair (CH)

( * ) Notice: Subject to any disclaimer, the term of this patent is extended or adjusted under 35 U.S.C. 154(b) by 441 days.

(21) Appl. No.: 15/471,972

(22) Filed: Mar. 28, 2017

(65) Prior Publication Data

US 2017/0275922 A1 Sep. 28, 2017

Related U.S. Application Data

(60) Provisional application No. 62/314,050, filed on Mar. 28, 2016.

(51) Int. Cl.

| | |
|---|---|
| ***E05B 59/00*** | (2006.01) |
| ***E05C 9/02*** | (2006.01) |
| ***E05B 15/02*** | (2006.01) |
| ***E05C 9/18*** | (2006.01) |
| ***E05B 63/20*** | (2006.01) |

(52) U.S. Cl.

CPC ..... *E05B 59/00* (2013.01); *E05B 15/022* (2013.01); *E05B 63/20* (2013.01); *E05C 9/021* (2013.01); *E05C 9/023* (2013.01); *E05C 9/1808* (2013.01); *E05C 9/1891* (2013.01)

(58) Field of Classification Search

CPC ..... E05B 59/00; E05B 15/022; E05B 63/20; E05B 63/18; E05B 63/205; E05B 2063/207; E05C 9/021; E05C 9/1891; E05C 9/023; E05C 9/1808

USPC ..... 70/107–111, 481, 482, 486, DIG. 6, 150, 70/151 R, 151 A, 152, 153, 116; 292/332–336, 169.13, 169.14, 169.15, 292/169.16, 169.17, 340, 341, 341.12, 292/341.13, 341.15, 73, 75, 77, 79, 193, 292/239

See application file for complete search history.

(56) References Cited

U.S. PATENT DOCUMENTS 728,277 A * 5/1903 McCabe
1,236,352 A * 8/1917 Puckett ..... E05F 5/025 16/85

(Continued)

*Primary Examiner* — Lloyd A Gall
(74) *Attorney, Agent, or Firm* — Reinhart Boerner Van Deuren P.C.

(57) ABSTRACT

A multi-point locking arrangement is provided. The multi-point locking arrangement includes a primary lock bolt and an auxiliary lock bolt offset from the primary lock bolt. The multi-point locking arrangement, in an embodiment, uses a single actuation motion to transition between locked and unlocked states. The locking arrangement may also include a lockout device that prevents transitioning from the unlocked state to the locked state when the lockout device is not actuated. The locking arrangement may include a biased auxiliary strike plate that cooperate with the auxiliary lock bolt to provide improved alignment and a tighter seal.

21 Claims, 21 Drawing Sheets

(56) References Cited

U.S. PATENT DOCUMENTS

| | | | | |
|---|---|---|---|---|
| 1,494,949 | A * | 5/1924 | Butterworth | E05C 19/04 70/150 |
| 4,892,341 | A | 1/1990 | Dietrich | |
| 4,950,005 | A * | 8/1990 | Cudd | E05B 63/185 292/150 |
| 5,373,716 | A * | 12/1994 | MacNeil | E05C 9/026 292/165 |
| 6,209,931 | B1 * | 4/2001 | Von Stoutenborough | E05C 9/041 292/160 |
| 6,217,087 | B1 * | 4/2001 | Fuller | E05B 55/00 292/33 |
| 6,282,929 | B1 * | 9/2001 | Eller | E05C 9/02 70/109 |
| 7,025,394 | B1 * | 4/2006 | Hunt | E05C 9/021 292/142 |
| 7,178,839 | B2 * | 2/2007 | Tsai | E05B 65/0858 292/112 |
| 7,634,928 | B2 * | 12/2009 | Hunt | E05B 63/143 70/107 |
| 7,878,034 | B2 | 2/2011 | Alber et al. | |
| 8,161,780 | B1 | 4/2012 | Huml | |
| 8,550,506 | B2 * | 10/2013 | Nakanishi | E05B 63/185 292/162 |
| 9,790,716 | B2 * | 10/2017 | Hagemeyer | E05B 65/0858 |
| 2003/0160462 | A1 * | 8/2003 | Tonges | E05B 63/185 292/332 |
| 2008/0092606 | A1 * | 4/2008 | Meekma | E05B 63/0056 70/120 |
| 2009/0078011 | A1 * | 3/2009 | Avni | E05B 63/20 70/486 |

* cited by examiner

MULTI-POINT LOCK WITH SINGLE ACTUATION AND MISHANDLING DEVICE AND SELF-ALIGNING ENGAGEMENT

CROSS-REFERENCE TO RELATED PATENT APPLICATION

This patent application claims the benefit of U.S. Provisional Patent Application No. 62/314,050, filed Mar. 28, 2016, the entire teachings and disclosure of which are incorporated herein by reference thereto.

FIELD OF THE INVENTION

This invention generally relates to multi-point lock arrangements and methods of using same.

BACKGROUND OF THE INVENTION

Multi-point locking arrangements are typically used with door assemblies when it is desired to have a very secure locking relationship between two separate door components. The two separate door components could be a hinged panel (e.g. a hinged door) and a doorjamb; a sliding door and a doorjamb; a pair of hinged panels; etc.

The use of the multi-point locking arrangement provides multiple engagement locations between the door components to provide the improved engagement between the two components. Unfortunately, the increased securement comes at the price of increased complexity in the lock assembly, which can make these types of lock assemblies for doors difficult to actuate. More particularly, these types of lock assemblies may require a higher level of torque to actuate the various lock bolts.

As such, these types of lock assemblies often require a multi-step actuation procedure where the user first actuates a handle of the door assembly used to manipulate the latch and then a thumb turn or keyed lock cylinder is actuated to effectuate final locking of the lock assembly. The use of the handle helps the user generate greater torques to manipulate the more complex or resistive lock assembly between the locked and unlocked states. A further problem is created due to this type of arrangement. Namely, users often cannot figure out how to work the lock assembly as they are often not use to having to perform two separate manipulations to lock and unlock a door lock. This can lead to the user trying to force the key or thumb turn resulting in damage to the lock assembly.

The present invention provides improvements over the current state of the art.

BRIEF SUMMARY OF THE INVENTION

In one embodiment of the invention, a new and improved multi-point locking arrangement is provided. The multi-point locking arrangement includes a primary lock bolt; a first auxiliary lock bolt; a lock mechanism and a lockout device. The first auxiliary lock bolt is spaced from the primary lock bolt. The lock mechanism includes a rotational input device operably coupled to the primary lock bolt and first auxiliary lock bolt to drive the primary lock bolt and first auxiliary lock bolt when rotated. The rotational input device rotates between a locked state and an unlocked state. In the locked state, the primary lock bolt and first auxiliary lock bolt are extended. In the unlocked state, the primary lock bolt and first auxiliary lock bolt are retracted. The lockout device transitions between a released state and a lockout state. In the lockout state, the lockout device cooperates with the lock mechanism to prevent transitioning the rotational input device from the unlocked state to the locked state. In the released state, the lockout device permits the lock mechanism to transition the rotational input device from the unlocked state to the locked state. The lockout device is configured to transition from the lockout state to the released state when the lockout device is depressed.

In one embodiment, the lockout device contacts a lockout device strike plate to be carried by or forming part of a secondary door component to transition the lockout device to the released state. When the lockout device no longer contacts the lockout device strike plate, the lockout device transitions to the lockout state.

In one embodiment, manual actuation of the rotational input device only is required to actuate and extend the primary lock bolt and first auxiliary lock bolt when the lockout device is depressed and manipulation of a handle that controls a latch need not be actuated.

In one embodiment, the rotational input device is in the form of a thumb turn.

In one embodiment, the rotational input device is in the form of a keyed lock cylinder.

In one embodiment, the lockout device travels linearly along a lockout device axis. The lock out device is depressible along the lockout device axis. The lockout device includes a first catch component defining a first abutment. The lock mechanism includes a lock point actuation slide operably interposed between the rotational input and at least one of the primary lock bolt and first auxiliary lock bolt. The lock point actuation slide travels linearly along a lock point actuation slide axis between the unlocked state and the locked state. The lock point actuation slide includes a second catch component defining a second abutment. The first and second abutments interfere with one another when the lock mechanism is in the unlocked state and the lockout device is in the lockout state preventing movement of the lock point actuation along the lock point actuation slide along the lock point actuation slide axis.

In one embodiment the system further includes a handle and a latch. The latch is operably coupled to the handle. The latch is driveable from a latched state to an unlatched state by operation of the handle. Operation of the handle to drive the latch from the latched state to the unlatched state is operable to depress the lockout device and drive the lockout device from the lockout state to the released state.

In one embodiment, the latch travels along a latch axis as it transitions between the latched state and the unlatched state. The latch axis is generally parallel to and offset from the lockout device axis. The lockout device has a third abutment. The latch has a fourth abutment. The fourth abutment contacts the third abutment to drive the lockout device from the lockout state to the released state using the handle.

In one embodiment, the system includes a latch. The latch is operably driveable from a latched state to an unlatched state by pressing on a tapered surface of the latch. This may be done by contacting the tapered surface with a strike plate or manipulation of a handle, for example. Transitioning the latch from the latched state to the unlatched state is operable to depress the lockout device and drive the lockout device from the lockout state to the released state.

In one embodiment, the latch travels along a latch axis as it transitions between the latched state and the unlatched state. The latch axis is generally parallel to and offset from the lockout device axis. The lockout device has a third abutment. The latch has a fourth abutment. The fourth abutment contacts the third abutment to drive the lockout device from the lockout state to the released state due to actuation of the latch.

In one embodiment, a door arrangement comprising a locking arrangement described above is provided. The door arrangement includes a hinged panel carrying the primary lock bolt; the first auxiliary lock bolt; the lock mechanism; and the lockout device. A secondary door component carries a primary strike plate, a first auxiliary strike plate and a lockout device strike plate. The primary strike plate defines an opening receiving the primary lock bolt in the extended state when the hinged panel is in a closed position relative to the secondary door component. The first auxiliary strike plate defines an opening receiving the first auxiliary bolt in the extended state when the hinged panel is in a closed position relative to the secondary door component. The lockout device contacts the lockout device strike plate when the hinged panel is in a closed position relative to the secondary door component to transition the lockout device to the released state. When the hinged panel transitions from the closed position relative to the secondary door component such that the lockout device no longer contacts the strike plate, the lockout device transitions to the lockout state.

In an embodiment, when extended, the primary lock bolt and first auxiliary lock bolt extend a first distance from a lateral edge of the hinged panel. When retracted, the primary lock bolt and first auxiliary lock bolt extend a second lesser distance from a lateral edge of the hinged panel or are recessed below the lateral edge of the hinged panel.

In an embodiment, the lockout device contacts a lockout device strike plate to be carried by or formed by a secondary door component to transition the lockout device to the released state. When the lockout device no longer contacts the lockout device strike plate, the lockout device transitions to the lockout state.

In another embodiment, a multi-point locking arrangement including a primary lock bolt, a first auxiliary lock bolt; a lock mechanism and a biasing auxiliary strike plate is provided. The first auxiliary lock bolt is spaced from the primary lock bolt. The lock mechanism includes a rotational input device operably coupled to the primary lock bolt and first auxiliary lock bolt. The rotational input device is rotatable between a locked state and an unlocked state. In the locked state, the primary lock bolt and first auxiliary lock bolt are extended. In the unlocked state, the primary lock bolt and first auxiliary lock bolt are retracted. The biasing auxiliary strike plate includes an opening through which the first auxiliary lock bolt extends when the lock mechanism is in the locked state. The biasing auxiliary strike plate includes a biasing mechanism for biasing the first auxiliary lock bolt in a direction transverse to a plane in which the first auxiliary lock bolt transitions as it transitions between the retracted and extended states and through the opening.

In one embodiment, the biasing mechanism is a spring biased roller.

In one embodiment, the biasing mechanism extends across the opening a first extent when the first auxiliary lock bolt is removed from the opening and a second lesser extent when the first auxiliary lock bolt extends through the opening.

In one embodiment, a primary strike plate is proved that includes an opening through which the primary lock bolt extends when the lock mechanism is in the locked state.

In one embodiment, a door arrangement including a lock assembly with a biasing auxiliary strike plate as described above is provided. The door assembly includes a hinged panel carrying the primary lock bolt; the first auxiliary lock bolt in spaced relation of the primary lock bolt. A secondary door component carries the biasing auxiliary strike plate such that receipt of the first auxiliary lock bolt into the opening of the biasing auxiliary strike plate locks the hinged panel to the secondary door component.

In an embodiment, the secondary door component is a door jamb.

In an embodiment, the secondary door component is a second hinged panel.

In an embodiment, the door jamb includes weather stripping against which the hinged panel is pressed when the hinged panel is in a closed state. The biasing mechanism biases the first auxiliary lock bolt and the hinged panel toward the weather stripping.

Methods of operating the multi-point lock arrangement and door assemblies are also provided including actuation and engagement of the various components.

In an embodiment, a multi-point locking arrangement including a primary lock bolt, a first auxiliary lock bolt, and a lock mechanism is provided. The first auxiliary lock bolt is spaced from the primary lock bolt. The lock mechanism includes a rotational input device operably coupled to the primary lock bolt and first auxiliary lock bolt, the rotational device rotatable between a locked state and an unlocked state. In the locked state, the primary lock bolt and first auxiliary lock bolt are extended. In the unlocked state, the primary lock bolt and first auxiliary lock bolt are retracted. The rotational input device is rotatable between the locked state and unlocked state without requiring manipulation of a secondary component. For example, the rotational input device can be rotated without first requiring manipulation of a handle connected to a hinged panel.

In one embodiment, the rotational input device is one of a thumb turn or a keyed lock cylinder.

Other aspects, objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Figure 1:
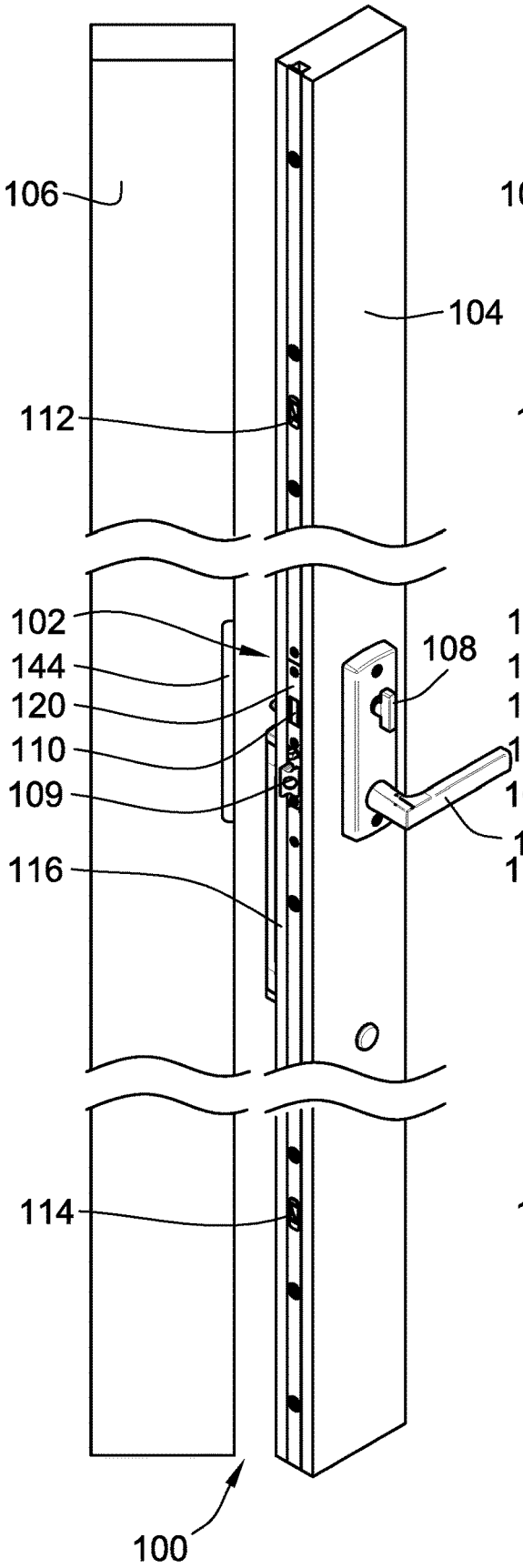
FIG. 1 is a door assembly according to an embodiment of the invention illustrated with the multi-point locking arrangement thereof in a retracted state and the door assembly in an open position.
Figure 2:
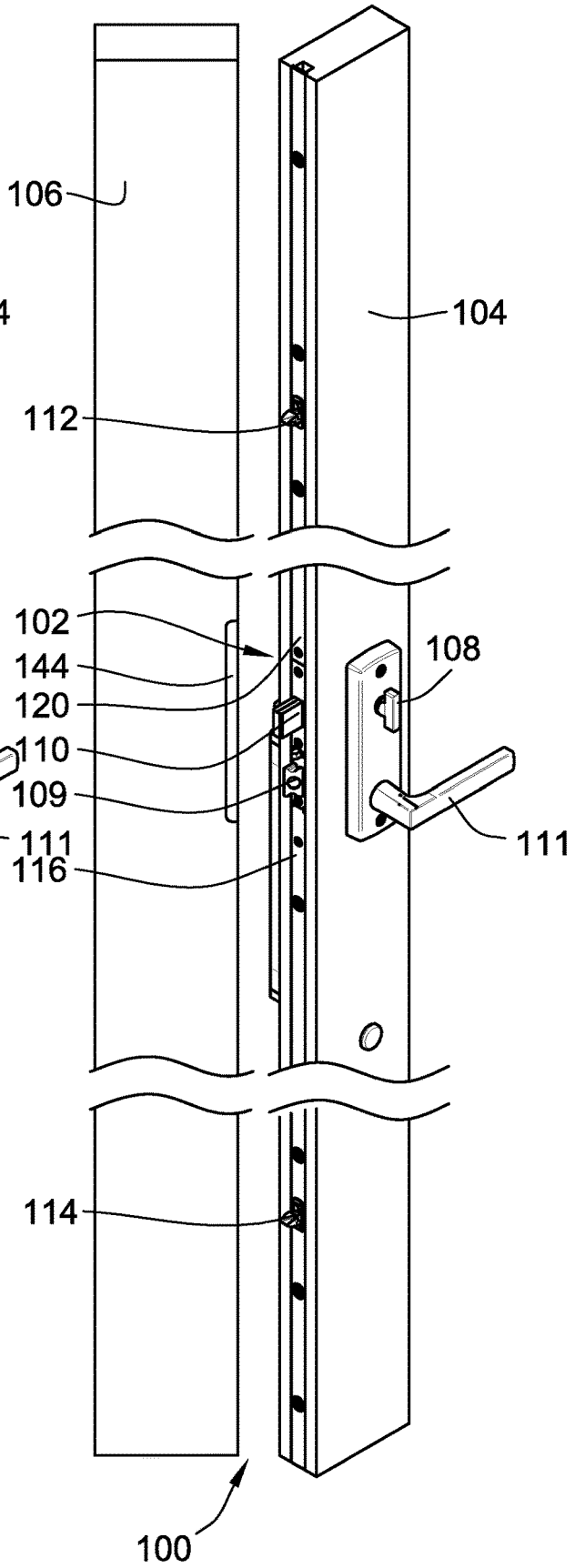
FIG. 2 is the door assembly according to FIG. 1 with the multi-point locking arrangement thereof in an extended state and the door assembly in an open position.

FIGS. 1 and 2 illustrate a simplified representation of an embodiment of a door assembly 100. The door assembly 100 includes a multi-point locking arrangement 102 for locking the door assembly 100 in a closed state.

The simplified door assembly 100 includes a hinged panel 104, which may take the form of a hinged door in practice. The door assembly 100 further includes a secondary door component 106 which may take the form of a door jamb in a single panel door assembly or a second hinged panel or hinged door in a multiple panel door assembly. In the illustrated embodiment, the secondary door component 106 is representative of a doorjamb.

The door assembly 100 includes a handle 111 and latch 109 for selectively maintaining the hinged panel 104 and secondary door component in a closed state and which can, typically, be manipulated whether or not the multi-point locking arrangement 102 is in a locked state or unlocked state. The latch 109 will hold the hinged panel 104 in a closed state relative to the secondary door component 106 at least when the multi-point locking arrangement 102 is in an unlocked state.

Figure 3:
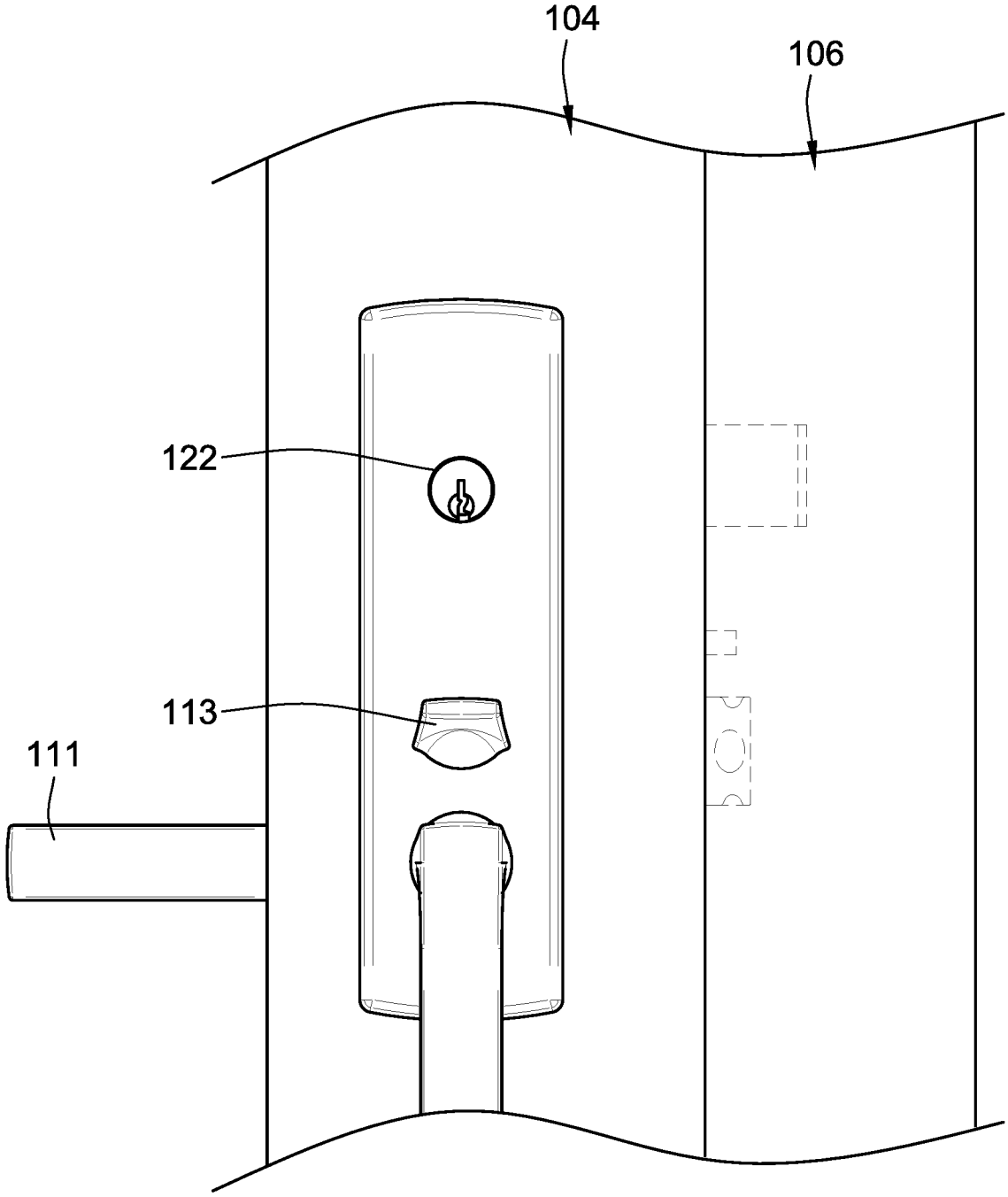
FIG. 3 is a partial illustration of the exterior of the door assembly of FIG. 1 in a closed position.
Figure 4:
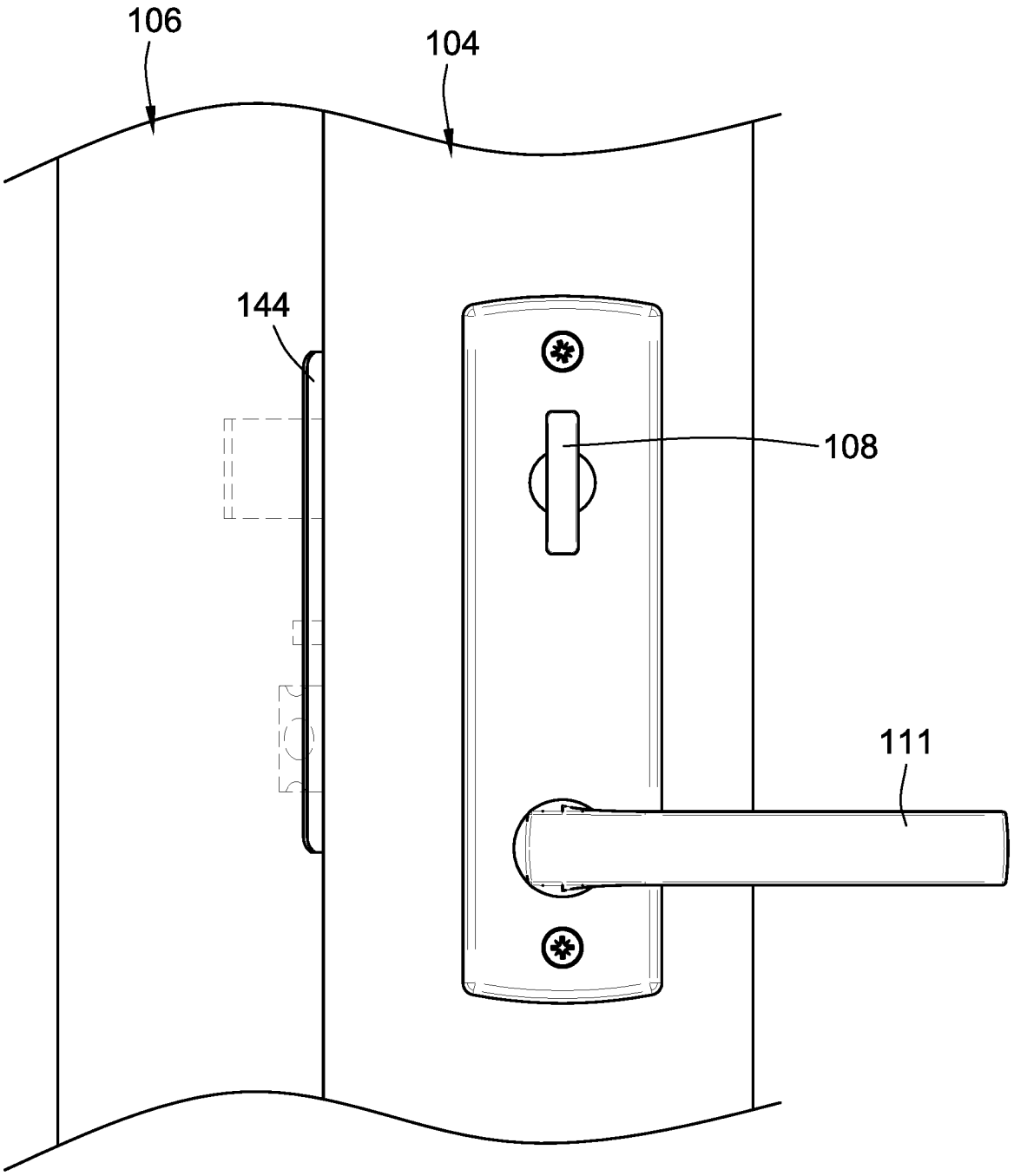
FIG. 4 is a partial illustration of the interior of the door assembly of FIG. 1 in a closed position.

The multi-point locking arrangement 102 operates to lock the hinged panel 104 in a closed state (see e.g. FIGS. 3 and 4).

FIGS. 1, 2 and 4 illustrate the door assembly 100 from an interior point of view. In this embodiment, the multi-point locking arrangement 102 includes a rotational input device in the form of rotatable thumb turn 108 that is actuated to lock the multi-point locking arrangement 102. The rotatable thumb turn 108 is operably connected to multiple bolts for locking the two door components 104, 106 together. In the illustrated embodiment, the thumb turn 108 is operably coupled to locking features including a primary lock bolt in the form of deadbolt 110 and first and second auxiliary lock bolts 112, 114.

Figure 6:
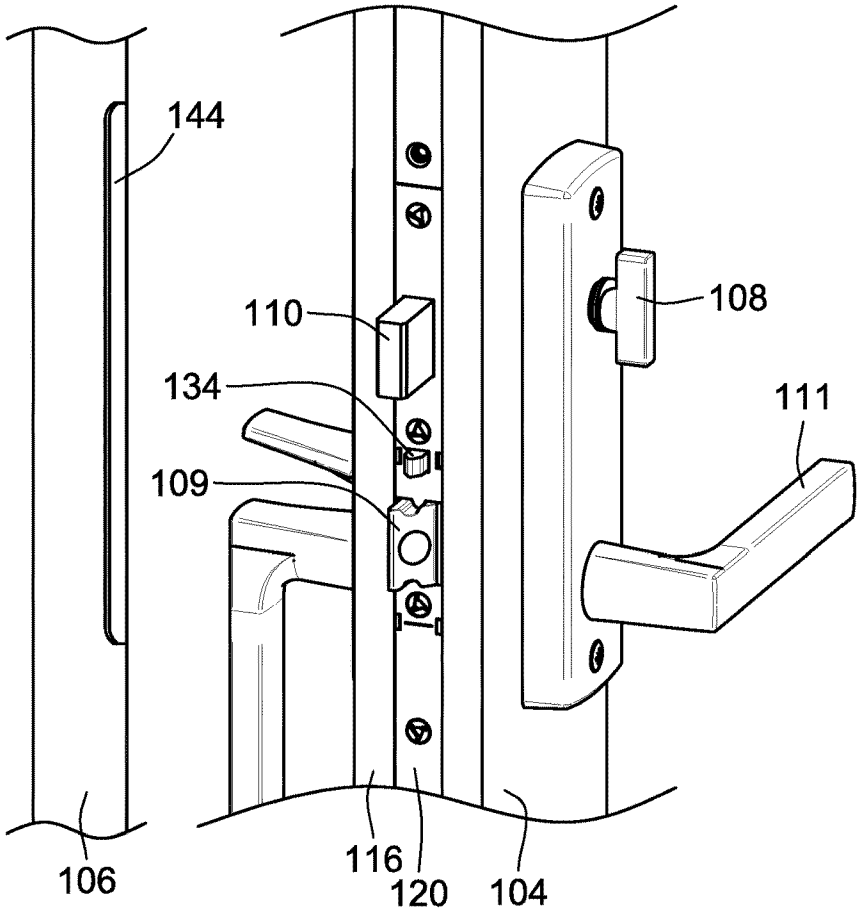
FIG. 6 is an enlarged partial illustration of FIG. 2.
Figure 5:
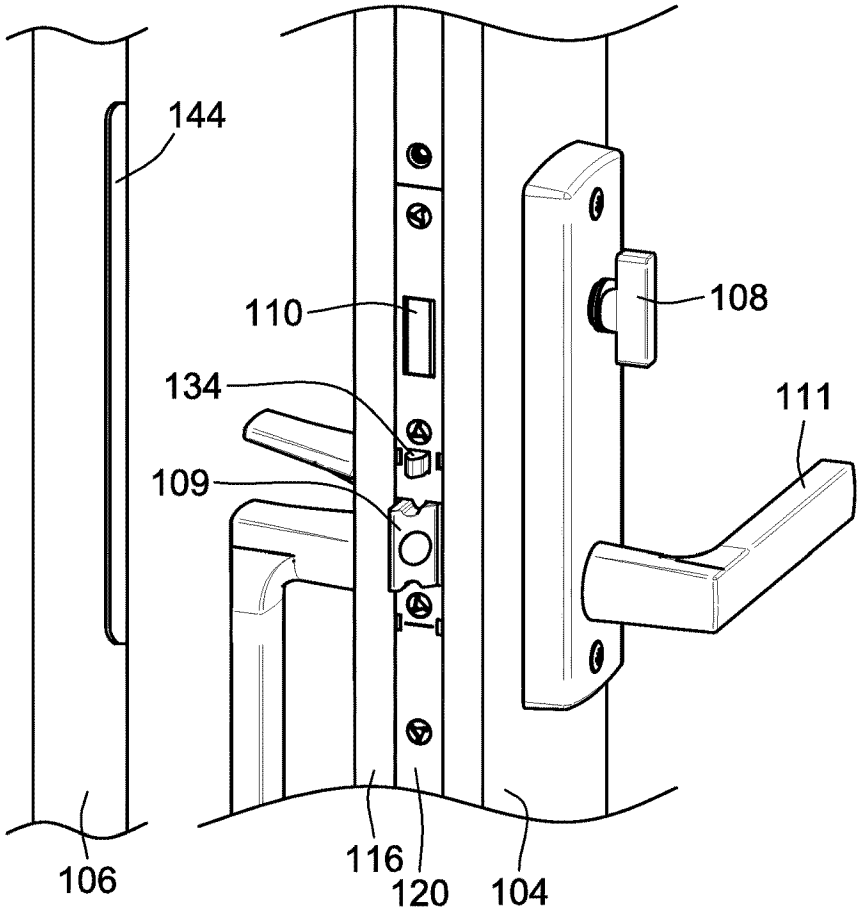
FIG. 5 is an enlarged partial illustration of FIG. 1.
Figure 7:
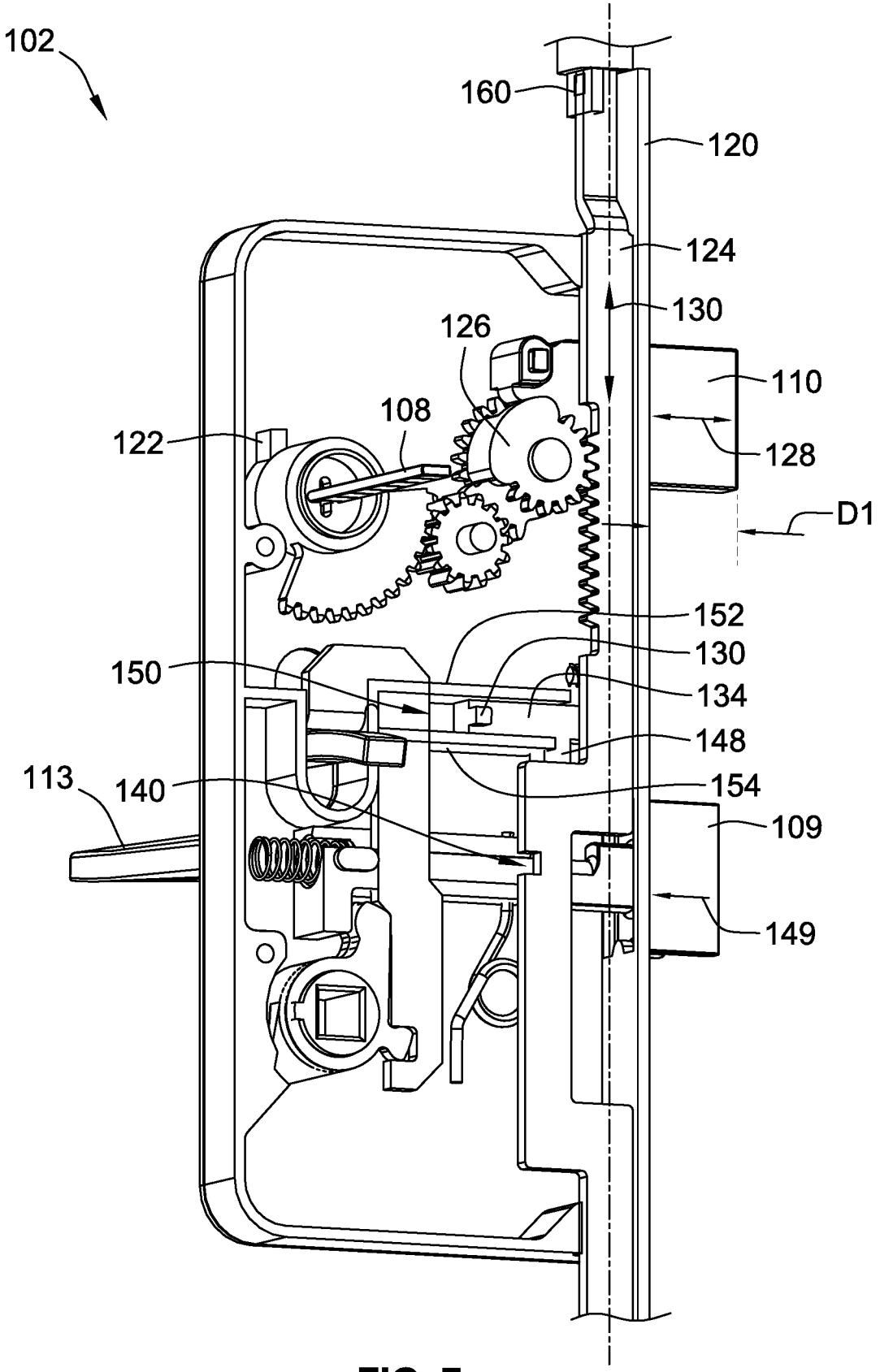
FIG. 7 is a simplified partial illustration of a portion of the multi-point locking arrangement of FIG. 2 with the deadbolt in an extended state and the lockout device in a released state.
Figure 8:
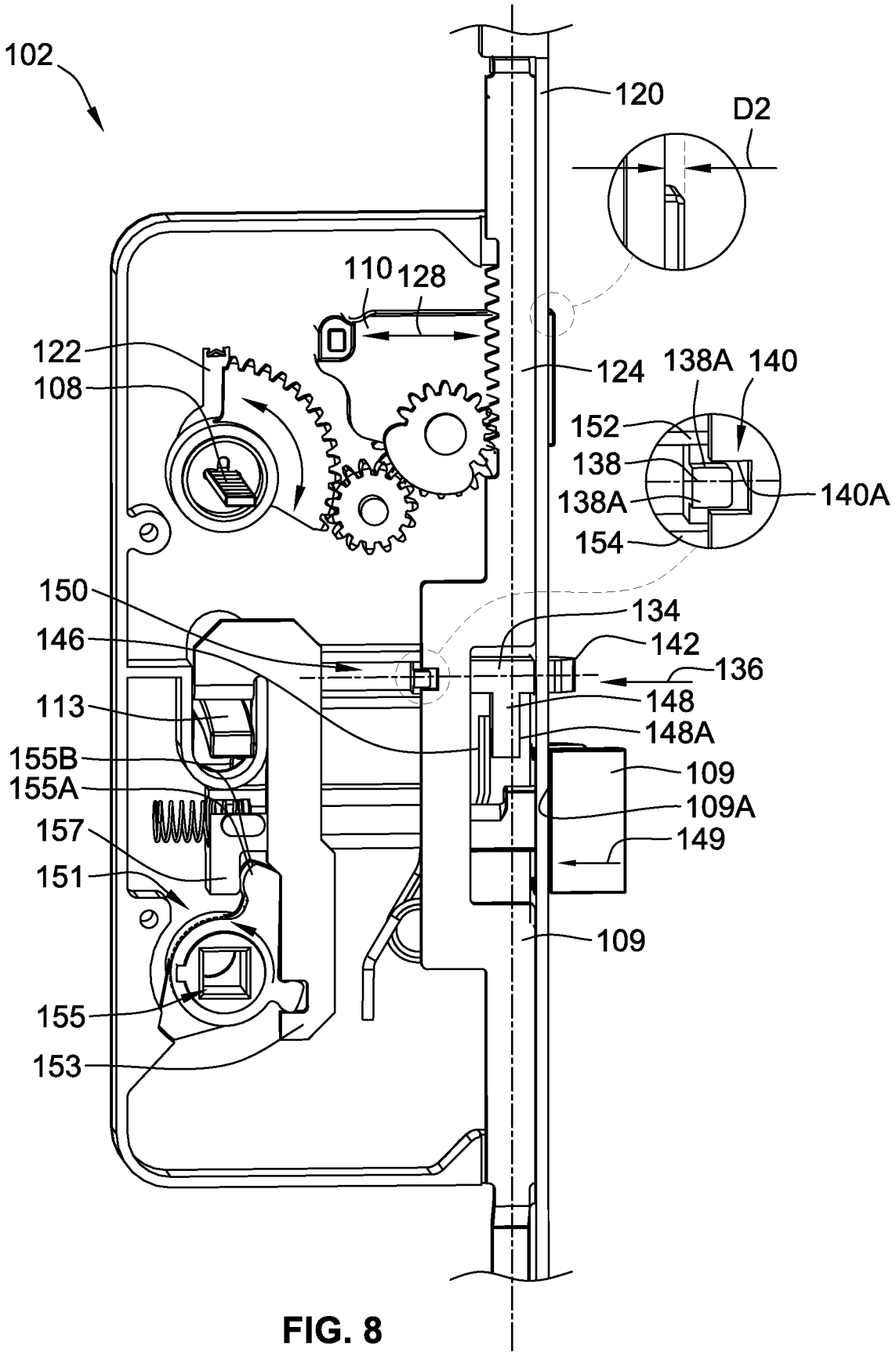
FIG. 8 is a simplified partial illustration of a portion of the multi-point locking arrangement of FIG. 2 similar to FIG. 8 with the deadbolt in a retracted state and the lockout device in a lockout state.

Rotation of the thumb turn 108 transitions the deadbolt 110 and auxiliary lock bolts 112, 114 from a retracted state also referred to as the unlocked state (FIGS. 1, 5 and 8) to an extended state also referred to as the locked state (FIGS. 2, 6 and 7). With reference to FIG. 7, in the extended state, the deadbolt 110 and auxiliary lock bolts 112, 114 extend a first extent (D1) from a lateral edge 116 of the hinged panel 104 sufficient to operably interact with the secondary door component 106 to lock the two components together. The first extent the deadbolt extends could be different than a first extent that the auxiliary lock bolts extend. In the retracted state, the deadbolt 110 and auxiliary lock bolts 112, 114 are preferably retracted into the hinged panel 104 such that they do not extend outward beyond lateral edge 116. However, the deadbolt 110 and auxiliary lock bolts 112, 114 need not be fully retracted and can extend outward beyond the lateral edge 116 if they are sufficiently retracted that they disengage the cooperating structure of/carried by the secondary door component. In FIG. 8, the deadbolt 110 is illustrated such that it is not fully retracted and extends outward a second extent D2. Again, while not illustrated in FIG. 8, the auxiliary lock bolts 112, 114 could extend a second extent that is different than the second extent of the deadbolt.

In FIGS. 7 and 8 the lateral edge of the hinged panel is represented by a cover 120 that covers the multi-point locking arrangement 102 when it is installed in a narrow groove in the lateral edge of the hinged panel 104.

Figure 9:
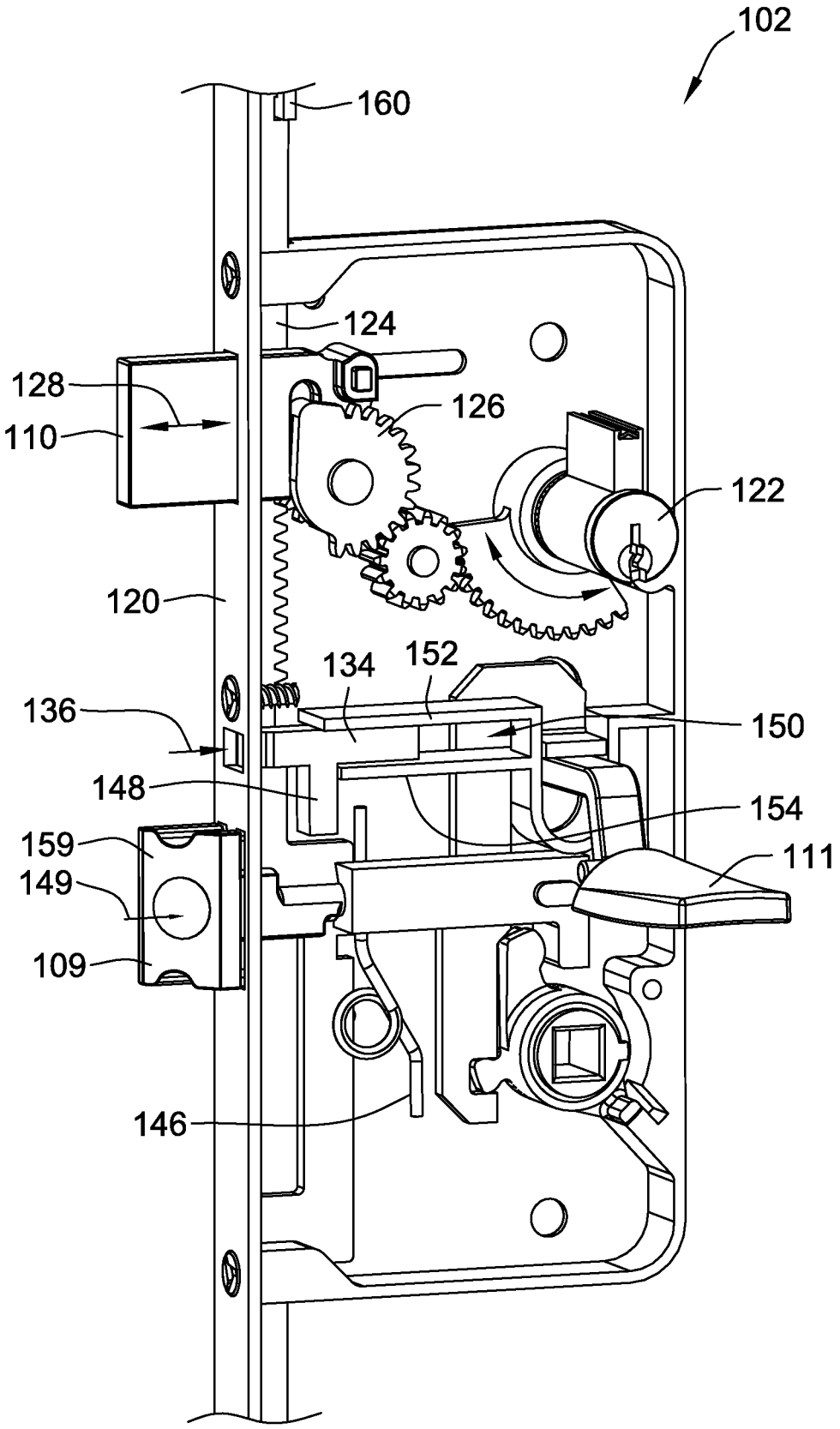
FIG. 9 is a simplified partial illustration of a portion of the multi-point locking arrangement of FIG. 2 from an opposite side as FIG. 7.

With reference to FIGS. 7-9, the multi-point locking arrangement 102 (illustrated in part) includes a lock mechanism that includes a keyed lock cylinder 122 that can be actuated by the user to transition the multi-point locking arrangement 102 between the locked state (FIGS. 7 and 9) and the unlocked state (FIG. 8). The lock cylinder 122 will be on the exterior of the hinged panel while the thumb turn 108 (see e.g. FIG. 4 and illustrated in simplified form by tab 108 in FIGS. 7 and 8 on which a thumb turn would be mounted) is typically on the interior of the hinged panel. In some embodiments of the lock mechanism, only keyed locks are provided or only thumb turns are provided. Keys or the keyed lock cylinder 122 as well as the thumb turn 108 may also be referred to as rotational input devices.

Rotation of the thumb turn 108 or keyed lock cylinder 122 will operably linearly drive lock point actuation slide 124 and the deadbolt 110 of the lock mechanism via a set of cooperating gears and/or linkages of the lock mechanism operably interposed therebetween. In the illustrated embodiment, rotation of the thumb turn 108 or keyed lock cylinder 122 operably drives the deadbolt actuator 126 which drives the deadbolt 110 between retracted and extended states illustrated by arrow 128 linearly along a deadbolt axis that is parallel to arrow 128. The deadbolt actuator 126 is also operably engaged with the lock point actuation slide 124 to drive the lock point actuation slide 124 as illustrated by arrow 130 linearly along a lock point actuation slide axis parallel to arrow 130. Typically, the thumb turn 108 or keyed lock cylinder 122 will be rotated 90 degrees between the locked and unlocked states and preferably less than 120 degrees. However, other degrees of rotation are contemplated, such as for example, 180 degrees, or any amount between 90 degrees and 180 degrees or even less than 90 degrees.

It is a feature of embodiments of the invention that the multi-point locking arrangement includes a lockout device 134 that is transitionable between a released state (FIGS. 7 and 9) and a lockout state (FIG. 8). In the lockout state, the lockout device 134 cooperates with the lock mechanism, and in this embodiment, directly with the lock point actuation slide 124, to prevent transitioning the rotatable thumb turn 108 and the keyed lock cylinder 122 from the unlocked state to the locked state. In the released state, the lockout device 134 permits transitioning the rotatable thumb turn 108 and keyed lock cylinder 122 from the unlocked state to the locked state. The lockout device 134 is configured to transition from the lockout state to the released state when the lockout device 134 is depressed illustrated by arrow 136 along a lockout device axis that is parallel to arrow 136.

In the illustrated embodiment, the lockout device 134 includes a projection 138 that is selectively engaged with (FIG. 8) and disengaged from (FIG. 7) a cooperating notch 140 of the lock point actuation slide 124. The lockout device 134 is carried such that it cannot move relative to the hinged panel parallel to arrow 130. As such, when the projection 138 is received in notch 140, the lock point actuation slide 124 is prevented from sliding and being actuated by deadbolt actuator 126. Due to the gearing arrangement, this also prevents rotation of the keyed lock cylinder 122 or thumb turn 108. Thus, when the lockout device 134 is engaged with the lock point actuation slide 124, actuation of the deadbolt 110 and the auxiliary lock bolts is prevented. More particularly, projection 138 defines an abutment 138A that cooperates with and can abut with abutment 140A defined by notch 140. The interference provided by abutments 138A and 140A inhibits sliding motion of lock point actuation slide 124 along lock point actuation slide axis (illustrated by arrow 130 in FIG. 7). Thus, actuation of the deadbolt 110 and auxiliary lock bolts is prevented by the axial abutment of abutments 138A and 140A.

The lockout device 134 includes a contact end 142 that is configured to contact a strike plate 144 or other portion of the secondary door component 106 (e.g. a doorjamb) when the hinged panel 104 is in a closed position. The door jamb or strike plate may be referred to generically as a lockout device strike plate. When the contact end 142 contacts the strike plate 144, the lockout device 134 is depressed, as illustrated by arrow 136 along the lockout device axis, which causes the projection 138 to be disengaged from notch 140 which transitions the lockout device from the lockout state (FIG. 8) to the released state (FIG. 7). With the lockout device 134 depressed, the abutments 138A, 140A will no longer engage or cooperate with one another. Thus, once the lockout device 134 is depressed, the lock point actuation slide 124 is freed to slide along the lock point actuation slide axis as illustrated by arrow 130. With the lock point actuation slide 124 free to slide, the thumb turn 108 or keyed lock cylinder 122 are likewise free to be actuated to transition the deadbolt 110 and auxiliary lock bolts 112, 114 to their extended states and to lock the hinged panel 104 relative to the secondary door component 106. It is noted that the lockout device axis and lock point actuation slide axis are transverse to one another and ideally perpendicular to one another. The relative orientations of these axes of motion allow for the lockout device 134 to be moved to prevent the lockout device 134 from interfering with the motion of the lock point actuation slide 124.

Strike plate 144 may be the same strike plate that defines an opening for receiving the deadbolt 110 or a separate strike plate or a portion of the secondary door component as mentioned above.

The lockout device 134, when in the lockout state, prevents actuation of the deadbolt 110 and the auxiliary lock bolts 112, 114. This protects the secondary door component 106 as well as the multi-point locking arrangement from damage to a user trying to close the hinged panel 104 relative to the secondary door component 106 with the deadbolt 110 and auxiliary lock bolts 112, 114 in an extended state.

The lockout device 134 is spring biased toward the extended position illustrated in FIG. 8 by biasing spring 146 that presses on downward extending tab 148 of the lockout device 134. In the illustrated embodiment, the lockout device 134 is slidably carried in a channel 150 defined by opposed walls 152, 154 of a frame of the lock mechanism.

In this embodiment, the handle 111 (see FIGS. 1 and 2) or thumb piece 113 are operably coupled to latch 109 to drive the latch 109 linearly along a latch axis between a latched state (see FIGS. 7-9) and an unlatched state. In the unlatched state, the latch 109 is retracted relative to the edge of the hinged panel (illustrated by arrow 149).

With reference to FIG. 8, the lockout device 134 and latch 109 include corresponding abutments 148A and 109A that can engage one another if the lockout device 134 is in the lockout state and the latch 109 is transitioned from the latched state to the unlatched state. As the handle 111 or thumb piece 113 drives the latch 109 inward as illustrated by arrow 149, the latch 109 and particularly abutment 109A will engage abutment 148A and retract the lockout device 134 (illustrated by arrow 136) and transition the lockout device to the released state. This allows a user to transition the multi-point locking arrangement 102 and particularly the deadbolt 110 and auxiliary lock bolts 112, 114 from the retracted state to the extended state by manually rotating thumb turn 108 or keyed lock cylinder 122. Alternatively, a user can manually depress the lockout device 134 by pressing on contact end 142. Further, this also allows the latch 109 to drive the lockout device 134 inward as a hinged panel is being closed preventing the contact end 142 from sliding across the strike plate preventing wear to either the strike plate or contact end 142. Only when the latch 109 is extending into the hole of the strike plate will the contact end 142 contact the strike plate.

Handle 111 and thumb piece 113 are operably coupled to a rotational actuation mechanism 151 that operably drives the latch 109 to retract the latch 109 when rotated. Thumb piece 113 is linked to the actuation mechanism 151 by link 153 while handle 111 has a component that extends axially through and rotationally engages square bore 155. Rotation of corresponding components of the rotational actuation mechanism 151 causes one or more of fingers 155A, 155B to press on projection 157 operably connected to latch 109 to retract the latch 109.

Unlike the lock bolts, e.g. deadbolt 110 and auxiliary lock bolts 112, 114, the latch 109 is spring loaded and has a tapered face 159 (see FIG. 9) that allows the latch 109 to be retracted when contacting a strike plate or similar component of the secondary door component 106. Thus, the latch 109 will not be damaged if it is extended while the hinged panel is in an open position and is then closed.

While being illustrated as cooperating with the lock point actuation slide 124, in other embodiments, the lockout device 134 could cooperate and directly engage other components between or including the keyed lock cylinder 122 or thumb turn 108 and the lock bolts (deadbolt 110 and auxiliary lock bolts 112, 114) to prevent actuation thereof when the hinged panel 104 is not in a closed position. For instance, the lockout device 134 could have or cooperate with a dog or pawl that engages one of the gears in the drive train of the lock mechanism to selectively prevent actuation.

The lockout device 134 is configured such that it extends laterally outward from the lateral edge of the hinged panel or cover 120 a first extent in the lockout state and a second lesser extent (which may include being fully depressed or recessed) in the released state.

It is a further feature of embodiments that the multi-point locking arrangement is a single actuation locking system. Most multi-point locking arrangements that utilize more than a deadbolt typically require multiple actuations to drive the deadbolt and auxiliary lock bolts to the locked state. More particularly, the units would require the user to close the hinged panel and then manually actuate the handle that operates the latch of the door and then the keyed lock cylinder or thumb turn could be manipulated to actuate the deadbolt and auxiliary lock bolts. However, in embodiments of the present invention, the user simply closes the hinged panel 104 and then manipulates only the thumb turn 108 or the keyed lock cylinder 122.

Driverails 160 operably engaged with lock point actuation slide 124 are used to operably actuate the auxiliary lock bolts 112, 114. While only one driverail 160 is illustrated, attached to a top end of the lock point actuation slide 124, it should be understood that a second driverail could be coupled to a bottom end of the lock point actuation slide 124. The driverails will be driven axially within a groove formed in the lateral edge of the hinged panel 104. The groove is typically closed with cover 120 or could be in the form of a bore formed in the hinged panel 104.

Figure 10:
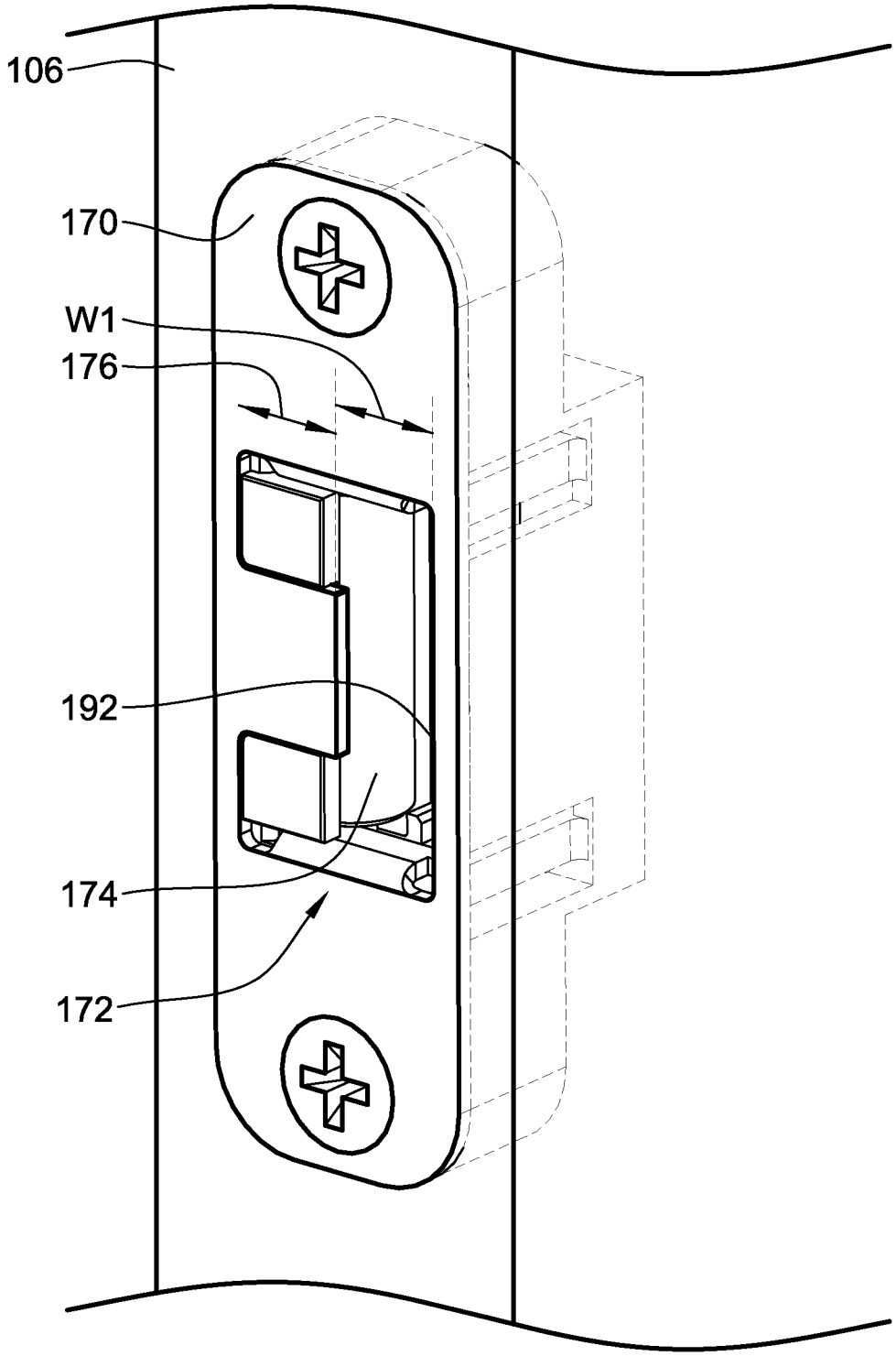
FIG. 10 is an illustration of a biasing auxiliary strike plate according to an embodiment of the invention and as used in the door assembly of FIG. 1.
Figure 11:
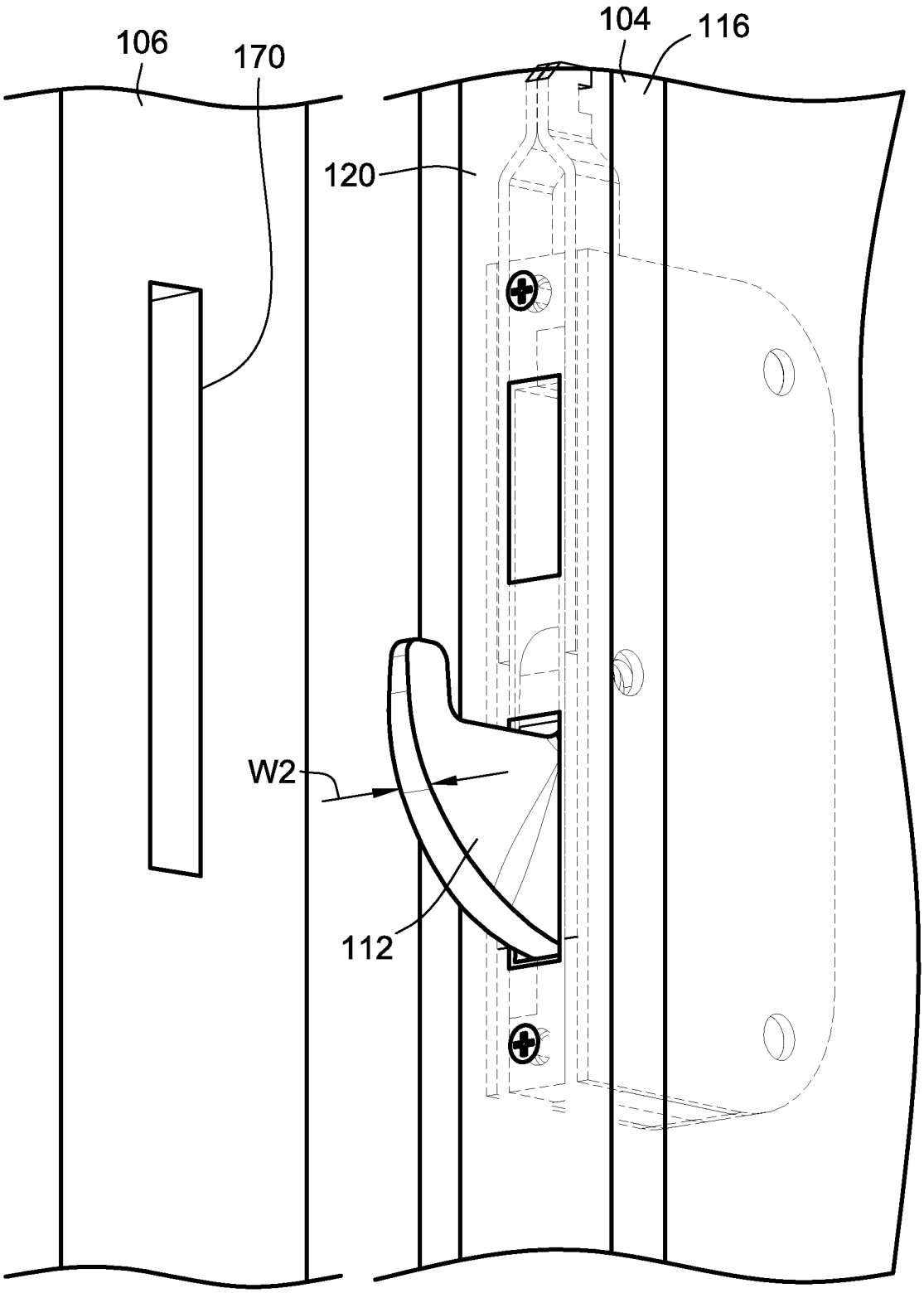
FIG. 11 is an illustration of an auxiliary lock bolt that cooperates with the biasing auxiliary strike plate of FIG. 10 with the auxiliary lock bolt in an extended state.

With reference to FIG. 10, the secondary door component 106 carries an auxiliary strike plate for each of the auxiliary lock bolts 112, 114. FIG. 10 illustrates a single auxiliary strike plate however it shall be understood that a strike plate is provided for each auxiliary lock bolt.

In the illustrated embodiment, the auxiliary strike plate is in the form of biasing auxiliary strike plate 170. The biasing auxiliary strike plate 170 defines an opening 172 that receives the auxiliary lock bolt 112, 114 to lock the hinged panel 104 to the secondary door component 106. Further, the biasing auxiliary strike plate 170 includes a biasing mechanism in the form of a spring loaded roller 174 that may be displaced when the auxiliary lock bolt 112, 114 is inserted into opening 172. The spring loaded roller 174 applies a force to the auxiliary lock bolt 112, 114 to bias the auxiliary lock bolt 112, 114 and consequently the hinged panel 104 in a direction perpendicular to a plane along which the auxiliary lock bolt 112, 114 travels as it is extended and inserted through opening 172. Preferably, the biasing force provided by the spring loaded roller 174 biases the hinged panel 104 into and against weather stripping (not shown) to improve the interaction of the hinged panel 104 with a corresponding piece of weather stripping.

The auxiliary lock bolt 112, 114 has a tapered design that promotes easier insertion into opening 172, but as the lock bolt 112, 114 is inserted further into the opening, the wider portion of the lock bolt 112, 114 promotes a tighter fit between the biasing auxiliary strike plate 170 and the auxiliary lock bolt 112, 114.

The width W1 of the opening 172 is sized to be larger than the width W2 of the auxiliary lock bolt 112, 114 to facilitate easy alignment and insertion of the auxiliary lock bolt 112, 114 into the opening 172. The spring loaded roller 174 allows the biasing auxiliary strike plate 170 to be self-aligning as the spring loaded roller 174 can translate parallel to arrow 176 to compensate for slight misalignment between the strike plate 170 and the auxiliary lock bolt 112, 114 but to still provide an engagement between the two components that does not exhibit undesirable slop or play. In a preferred embodiment, the spring loaded roller 174 is allowed to translate at least 0.0625" and will typically be allowed to translate at least 0.138". This amount of translation will allow for the lock bolts 112, 114 to be mis-aligned to these values but still be able to be received in the opening 172.

Figure 12:
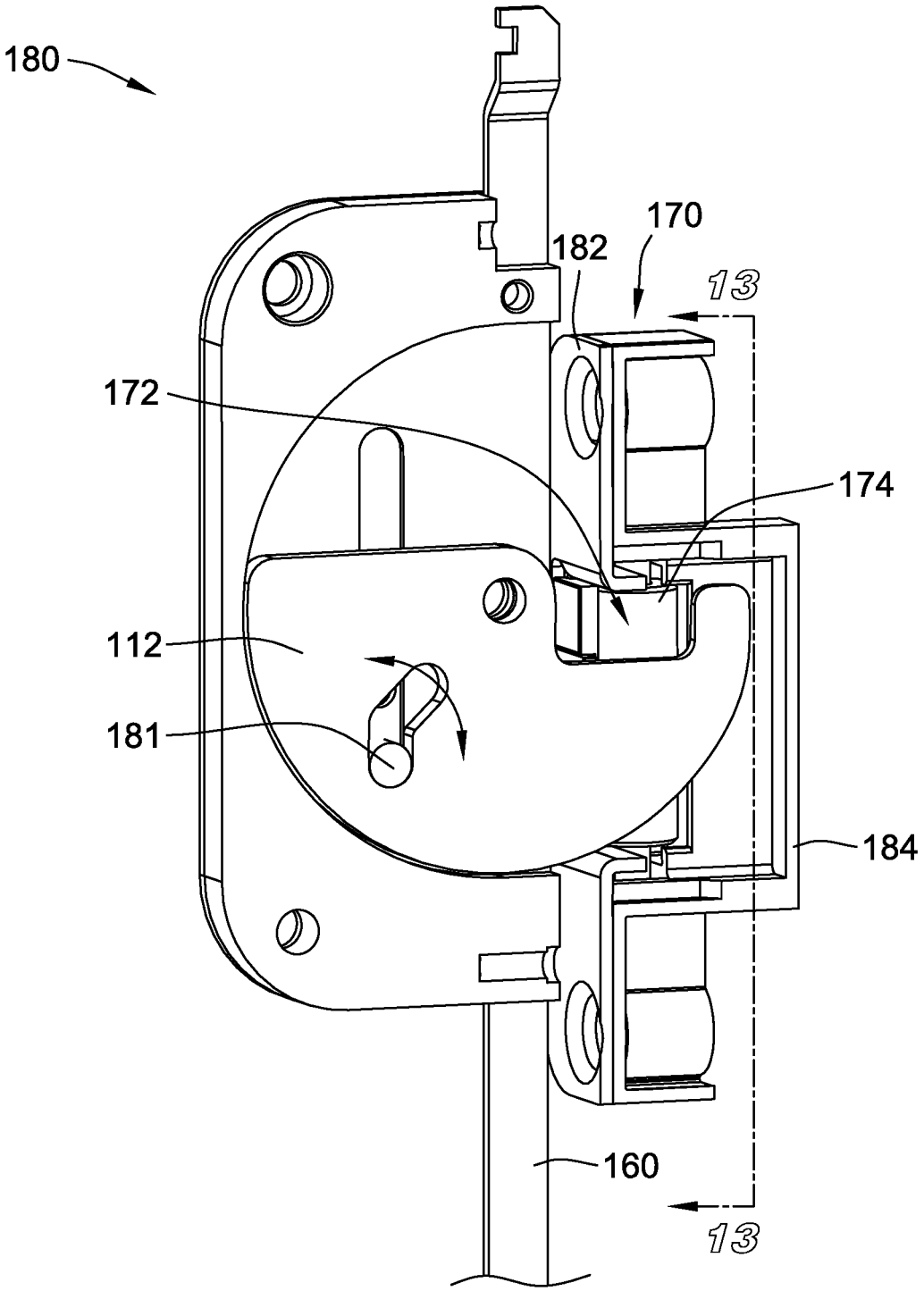
FIG. 12 is a simplified illustration of the lock bolt assembly of FIG. 11 engaging the biasing auxiliary strike plate of FIG. 10.

FIG. 12 illustrates an auxiliary lock bolt assembly 180 in cross-section. The auxiliary lock bolt assembly 180 includes auxiliary lock bolt 112 that is operably coupled to drive rail 160 to be driven angularly about pin 181 between its extended (FIG. 12) and retracted (not shown) states. Other auxiliary lock bolt assemblies may be used that simply linearly actuate the auxiliary lock bolt and may take the form of a shootbolt assembly.

The strike plate 170 defines a housing that holds spring loaded roller 174 and opening 172 through which the auxiliary lock bolt 112 extends when extended into the locked state. The housing includes a front strike plate panel 182 and a rear housing 184.

Figure 13:
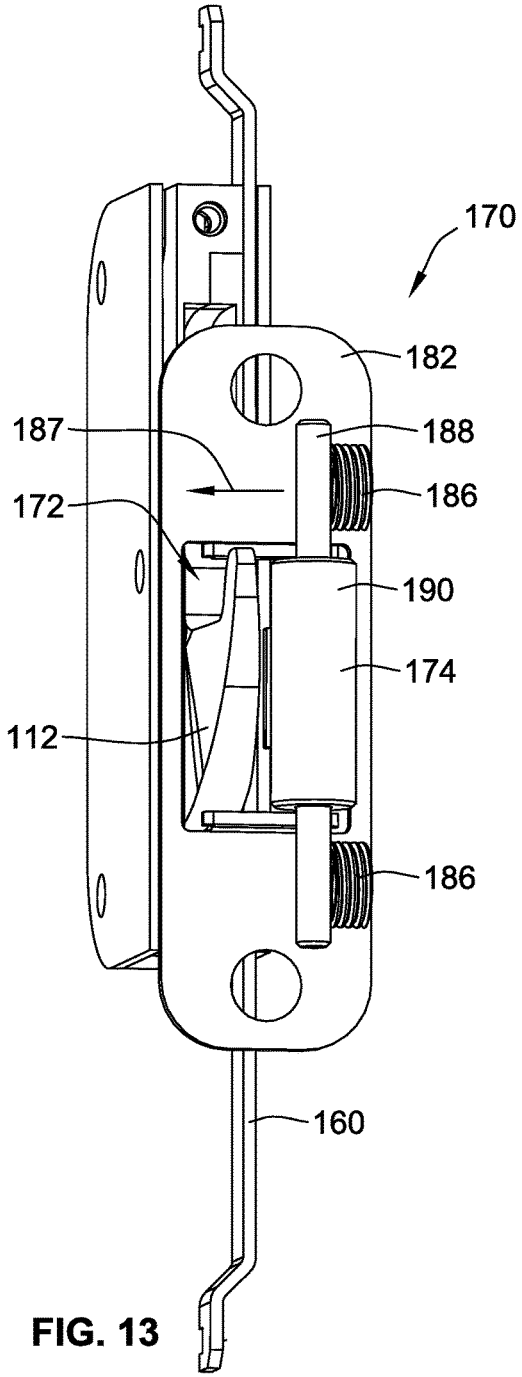
FIG. 13 is a partial illustration taken about line 13-13 in FIG. 12 of the strike plate and lock bolt combination of FIG. 12.

FIG. 13 illustrates the engagement of the auxiliary lock bolt 112 and the spring loaded roller 174. Further, FIG. 13 illustrates force 187 being applied to one side of the auxiliary lock bolt 112 by springs 186. The springs 186 press against pin 188 that carries roller 190 of the spring loaded roller 174. This force will ideally be at least 2.5 lbf per strike plate 170 and may be up to 8 lbf. Preferably, the force will be between 3.8 lbf and 6.7 lbf per strike plate 170.

Figure 14:
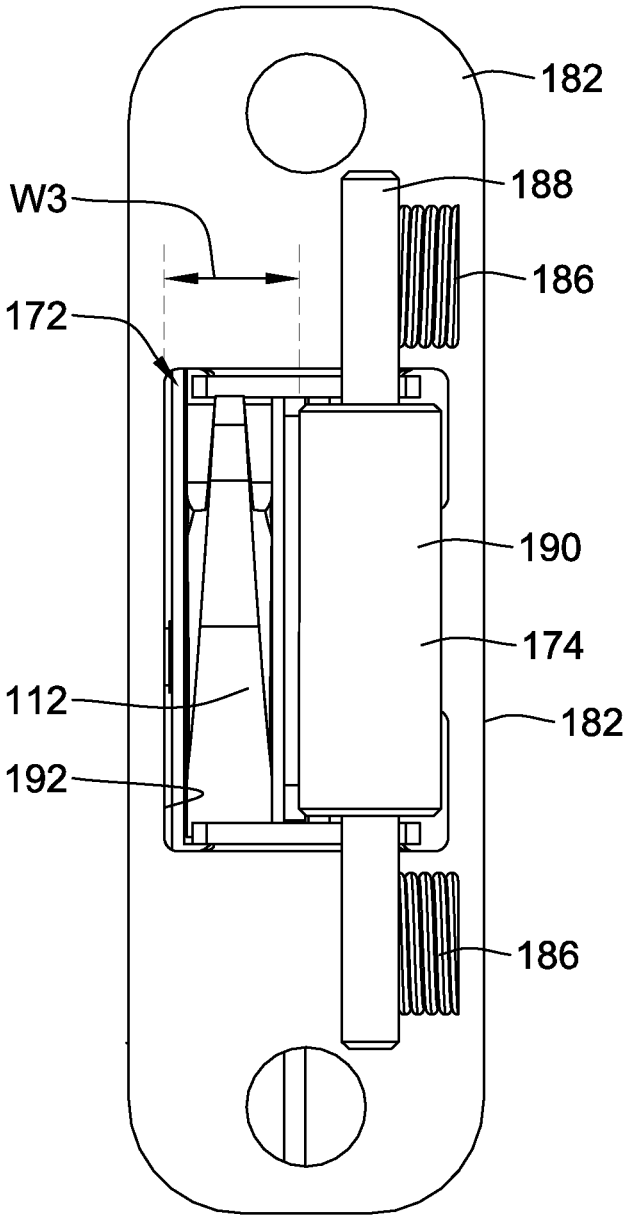
FIG. 14 is a simplified illustration of FIG. 13 illustrating the lock bolt inserted into the strike plate.
Figure 15:
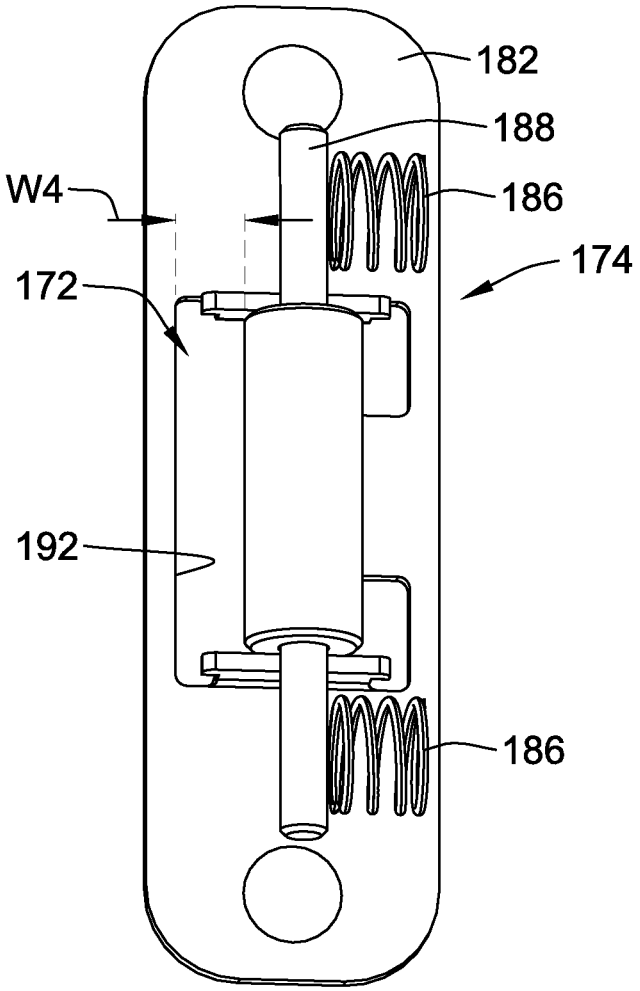
FIG. 15 is similar to FIG. 14 with the lock bolt removed from the strike plate.

FIGS. 14 and 15 schematically illustrate the translation of the spring loaded roller 174. FIG. 14 illustrates the position of spring loaded roller 174 when an auxiliary lock bolt is inserted into opening 172. In this position, the spacing between the spring loaded roller 174 and edge 192 of the opening 172 has a width W3 that will correspond to width W2 of the auxiliary lock bolt. In this illustration, bottom spring 186 is illustrated as compressed and the pin 188 is shown against the end of the bottom spring 186 to represent the auxiliary lock bolt biasing the spring loaded roller 174.

FIG. 15 illustrates the spring loaded roller 174 in relaxed state representing a position when the auxiliary lock bolt is not inserted into opening 172. The width W4 is smaller than width W3 as the spring loaded roller 174 has not been translated by the auxiliary lock bolt. Pin 188 is illustrated proximate the end of extended upper spring 186. The spring loaded roller 174 extends across a greater extent of opening 172 in FIG. 15 (when no auxiliary locking bolt is received in opening 172) than in FIG. 14 (which represents when an auxiliary locking bolt is received in opening 172). The compression of springs 186 when the auxiliary lock bolt is inserted into opening 172 provides the biasing force.

The use of the biasing auxiliary strike plate 170 helps reduce the amount of force necessary to drive the auxiliary lock bolts 112, 114 into the corresponding strike plates to assist in allowing for a single actuation step for transitioning the multi-point locking arrangement from the retracted (unlocked) state to the extended (locked) state while only using a key in the keyed lock cylinder 122 or the thumb turn 108. To the number of components and potential for misalignment which would cause increased friction or potential mechanical interference, the flexibility provided, in part, by the biasing auxiliary strike plate 170, the key or thumb turn 108 can be used even though these components are small and provide a limited lever arm to generate torque. For instance, in some embodiments, the width of the thumb turn 108 or key that would cooperate with the keyed lock cylinder would be no more than 2.5". At most, the lever arm from its rotational axis would be 2.5" to an end of the thumb turn. However, the thumb turn or key may be centered on the corresponding rotational axis such that the maximum lever arm for the thumb turn or key from the axis of rotation would be approximately 1.25". In a preferred embodiment, the width of the thumb turn 108 is between 1.25" and 1.5". In a preferred embodiment of a key, the width is between 1" and 1.25" and more preferably approximately 1.0625". The lever arm for the thumb turn or key would again be at most these values. However, the rotational axis is typically inboard of the ends and is most typically centered within these widths such that the lever arm would be approximately half of those values.

In prior assemblies, the handle for driving the latch was required to be used to drive the components of the multi-point locking arrangement so that a sufficient lever arm was available to actuate the lock components. For instance, a handle may extend outward from the rotational axis thereof by 3" or more and can be gripped by an entire hand rather than simply the thumb and index finger as in a thumb turn 108 or key. In embodiments, the multi-point lock arrangement is configured such that the torque required to actuate the deadbolt 110 and auxiliary lock bolts is less than 17.7 in-lbs.

Secondarily, the biasing auxiliary strike plate 170 increases the biasing of the hinged panel into any weather stripping that may be provided to further improve the sealing of the two door components to one another while still allowing some flexibility in the mounting of the components of the lock assembly to the various door components.

Figure 16:
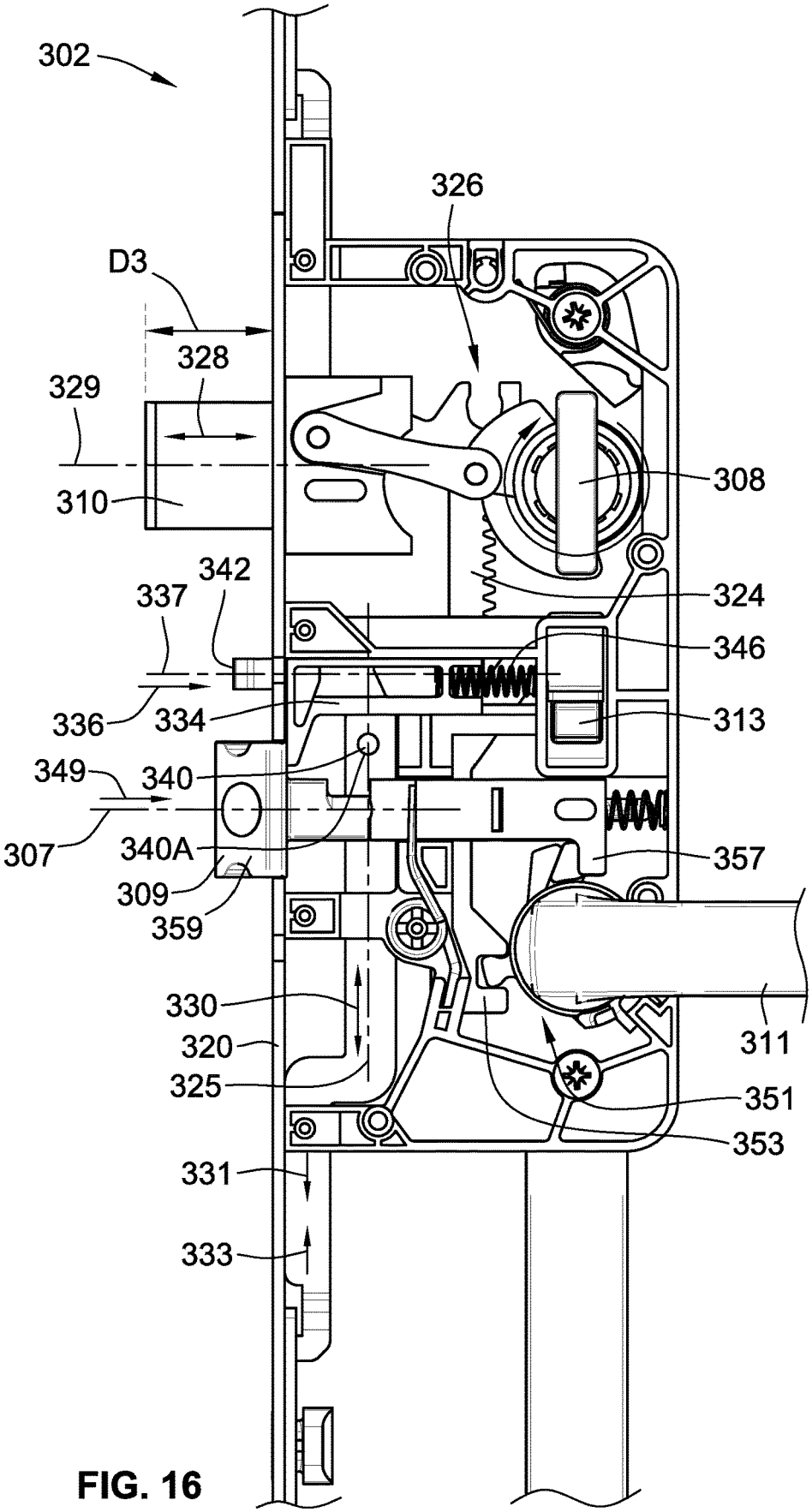
FIG. 16 is a simplified partial illustration of a portion of another embodiment of a multi-point locking arrangement with the deadbolt and latch extended and the lock out device in the lockout state.
Figure 17:
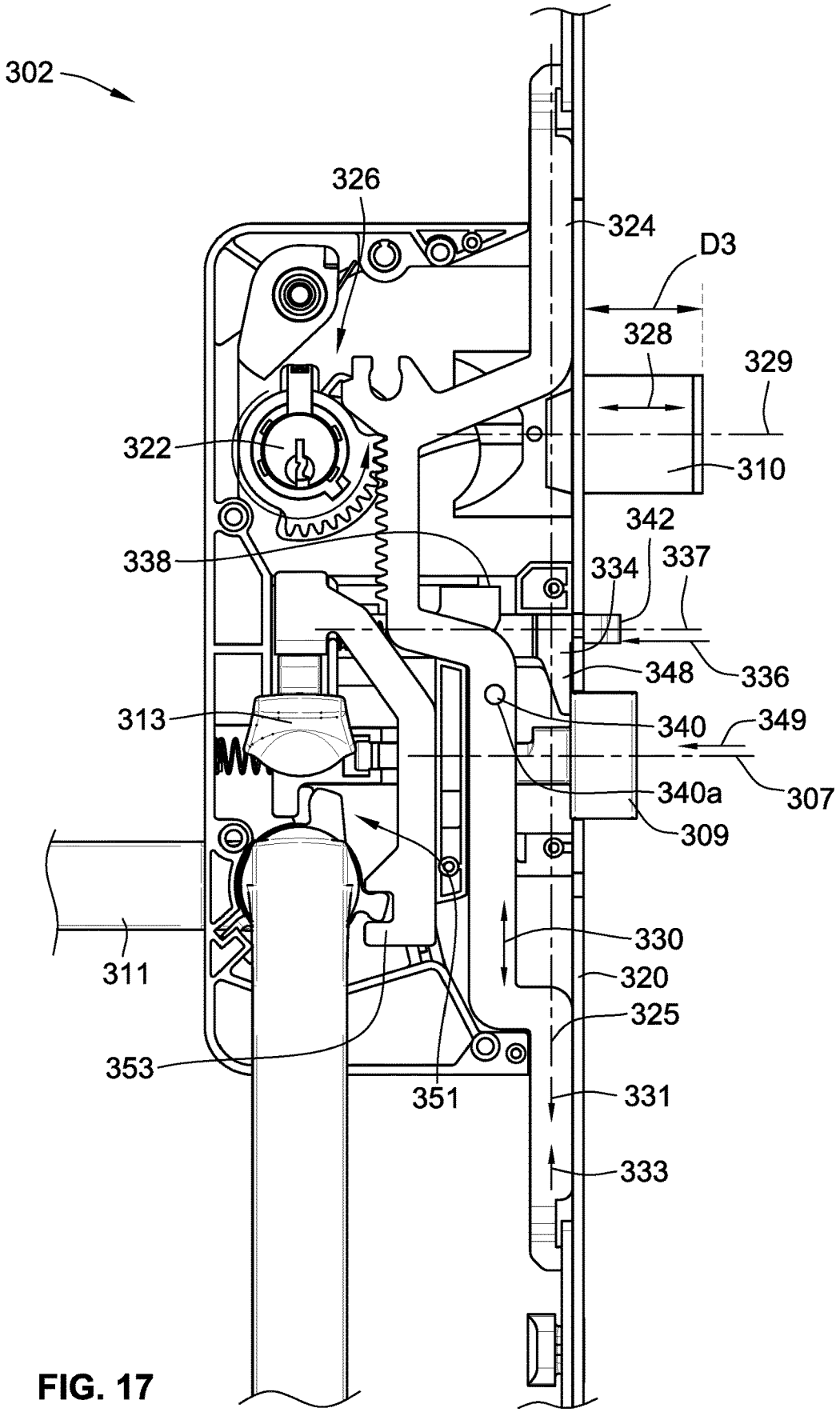
FIG. 17 is similar to FIG. 16 but viewed from the opposite side.

FIGS. 16-22 illustrate, in part, a further embodiment of a multi-point locking arrangement 302. This embodiment will be described as if it were installed in hinged panel 104. FIGS. 16 and 17 illustrates the multi-point locking arrangement 302 with the deadbolt 310 illustrated in an extended state. It is noted that, while not illustrated, the auxiliary lock bolt(s) would also be extended similar to auxiliary lock bolts 112, 114 of the prior embodiment.

FIGS. 18-22 illustrate the multi-point locking arrangement 302 with the deadbolt 310 illustrated in a retracted state. As outlined above, in the extended state, the deadbolt 310 and auxiliary lock bolts extend a first extent (D3) from an outer surface of cover 320 or alternatively lateral edge 116 (FIG. 2) of the hinged panel 104 sufficient to operably interact with the secondary door component 106 to lock the two components together like the prior embodiment. In the retracted state, the deadbolt 310 and auxiliary lock bolts are preferably retracted into the hinged panel 104 such that they do not extend outward beyond lateral edge 116 or cover 320. However, the deadbolt 310 and auxiliary lock bolts need not be fully retracted and can extend outward beyond the lateral edge 116 or cover 320 if they are sufficiently retracted that they disengage the cooperating structure of/carried by the secondary door component.

In FIGS. 16-22, the lateral edge of the hinged panel may be represented by cover 320 that covers the multi-point locking arrangement 102 when it is installed in a narrow groove in the lateral edge of the hinged panel 104.

With reference to FIGS. 16-22, the multi-point locking arrangement 302 (illustrated in part) includes a lock mechanism that includes a keyed lock cylinder 322 that can be actuated by the user to transition the multi-point locking arrangement 302 between the locked state (FIGS. 16 and 17) and the unlocked state (FIGS. 19-22). The lock cylinder 322 will be on the exterior of the hinged panel while a thumb turn 308 (e.g. thumb turn 108 in FIG. 4) is typically on the interior of the hinged panel. In some embodiments of the lock mechanism, only keyed locks are provided or only thumb turns are provided. Keys or the keyed lock cylinder 322 as well as the thumb turn 308 may also be referred to as rotational input devices.

Rotation of the thumb turn 308 or keyed lock cylinder 322 will operably linearly drive lock point actuation slide 324 and the deadbolt 310 of the lock mechanism via a set of cooperating gears or linkages of the lock mechanism operably interposed therebetween. In the illustrated embodiment, rotation of the thumb turn 308 or keyed lock cylinder 322 operably drives the deadbolt actuator arrangement 326 which drives the deadbolt 310 between retracted and extended states illustrated by arrow 328 linearly along a deadbolt axis 329. The deadbolt actuator arrangement 326 is also operably engaged with the lock point actuation slide 324, via a rack and pinion arrangement, to drive the lock point actuation slide 324 as illustrated by arrow 330 linearly along a lock point actuation slide axis 325. As used herein, "along" shall also include simply being "parallel to". Typically, the thumb turn 308 or keyed lock cylinder 322 will be rotated 90 degrees between the locked and unlocked states and preferably less than 120 degrees. However, other angular degrees of rotation are contemplated.

It is a feature of embodiments of the invention that the multi-point locking arrangement includes a lockout device 334 (see also FIG. 23) that is transitionable between a released state (FIGS. 20-22) and a lockout state (FIGS. 16-19). In the lockout state, the lockout device 334 cooperates with components of the lock mechanism, and in this embodiment the lock point actuation slide 324, to prevent transitioning the rotatable thumb turn 308 and the keyed lock cylinder 322 from the unlocked state to the locked state. In the released state, the lockout device 334 permits transitioning the rotatable thumb turn 308 and keyed lock cylinder 322 from the unlocked state to the locked state. The lockout device 334 is configured to transition from the lockout state to the released state when the lockout device 334 is depressed illustrated by arrow 336. It is noted that the lockout device 334 is configured such that, in the lockout state, if the lock mechanism is in the locked state (e.g. FIGS. 16 and 17, the thumb turn 308 and keyed lock cylinder 322 can be rotated between the locked state to the unlocked state without needing to manually manipulate other components other than the thumb turn 308 or keyed lock cylinder 322. This will be described more fully below.

Figure 18:
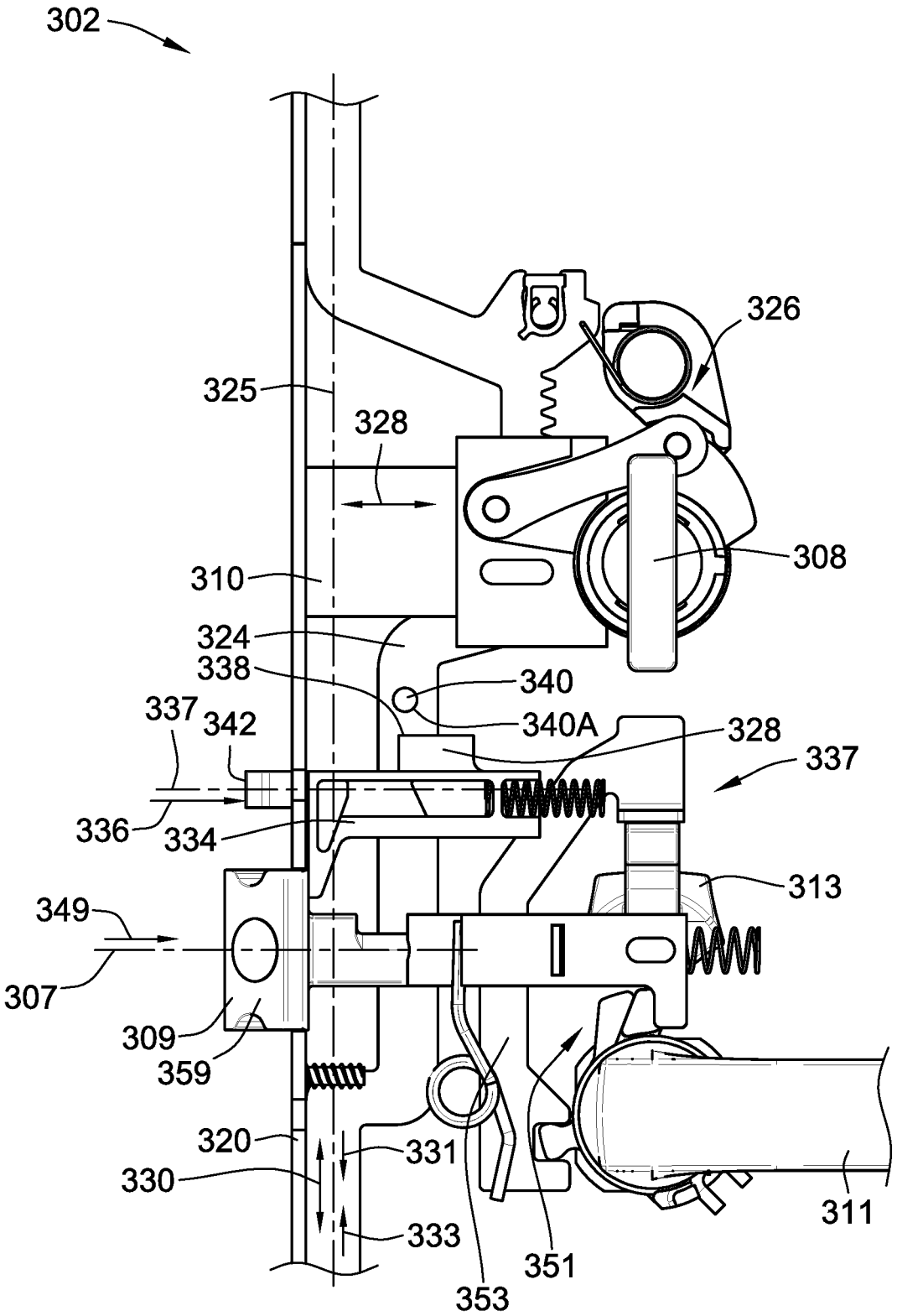
FIG. 18 is a simplified partial illustration of the embodiment of FIG. 16 with the deadbolt retracted and the lockout device in the lockout state.
Figure 19:
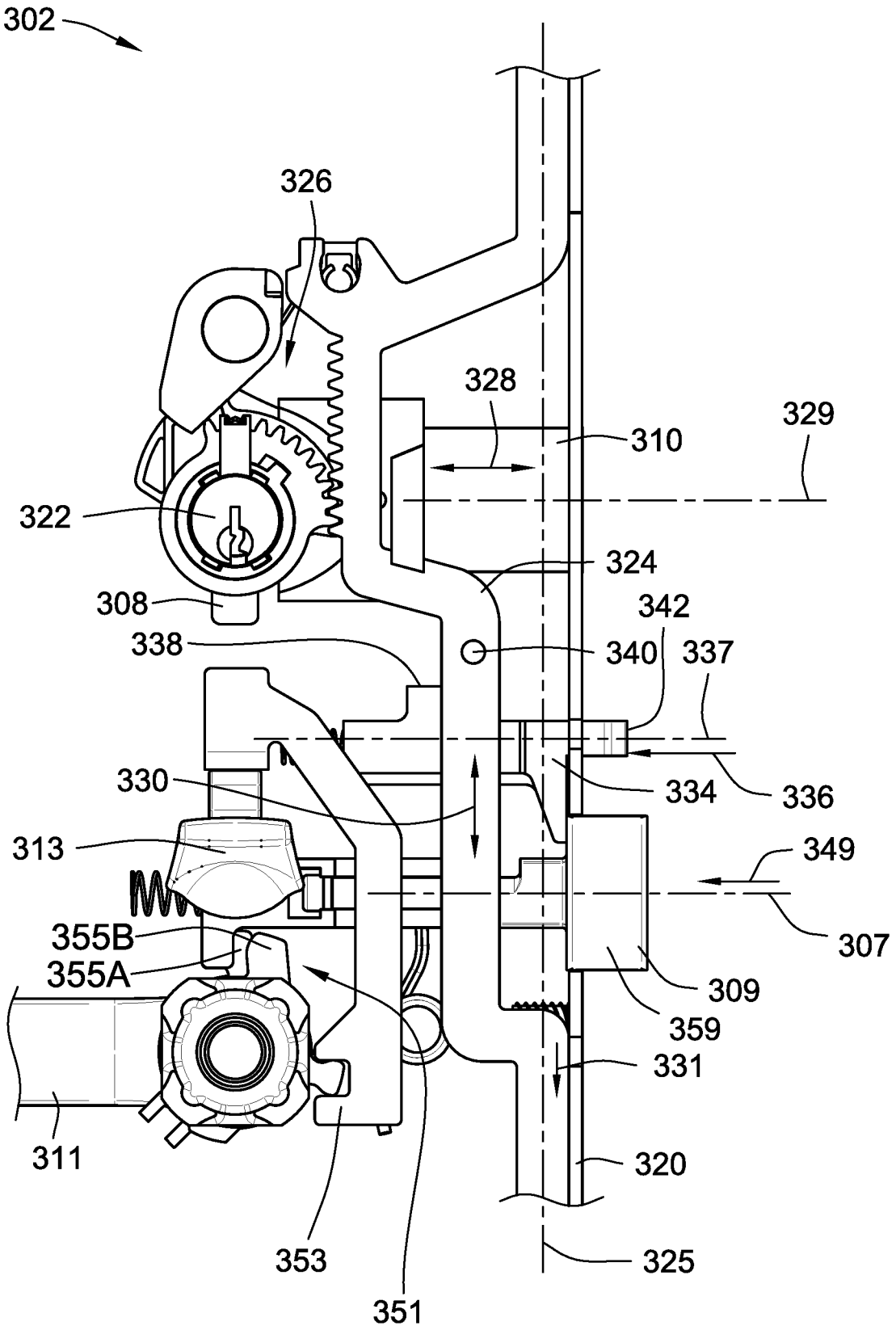
FIG. 19 is similar to FIG. 18 but viewed from the opposite side.

In the illustrated embodiment, the lockout device 334 includes an abutment 338 (see FIG. 17 for the abutment 338) that selectively engages or interferes) with a cooperating abutment 340A (see FIG. 17 for the abutment 340A) provided by a cooperating projection 340 of the lock point actuation slide 324. When in the lockout state and as illustrated in FIG. 18, the amount of motion parallel to the lock point actuation slide axis 325, e.g. parallel to arrow 330, is limited because abutment 338 will contact projection 340 and particularly abutment 340A. The lockout device 334 is carried such that it cannot move relative to the hinged panel parallel to arrow 330. As such, when the abutment 338 abuts against projection 340, the lock point actuation slide 324 is prevented from sliding in the direction illustrated by arrow 331 in FIGS. 18 and 19 and being actuated by deadbolt actuator arrangement 326. This also prevents or limits rotation of the keyed lock cylinder 322 or thumb turn 308. Thus, when the lockout device 334 is engaged with (e.g. abuts with) the lock point actuation slide 324 in this manner, actuation of the deadbolt 310 and the auxiliary lock bolts to the locked/extended state is prevented. More particularly, abutment 338 cooperates with and can abut with abutment 340A defined by projection 340. The interference provided by abutments 338 and 340A inhibits sliding motion of lock point actuation slide 324 along lock point actuation slide axis 325 in the direction of arrow 331 parallel to axis 325.

Figure 20:
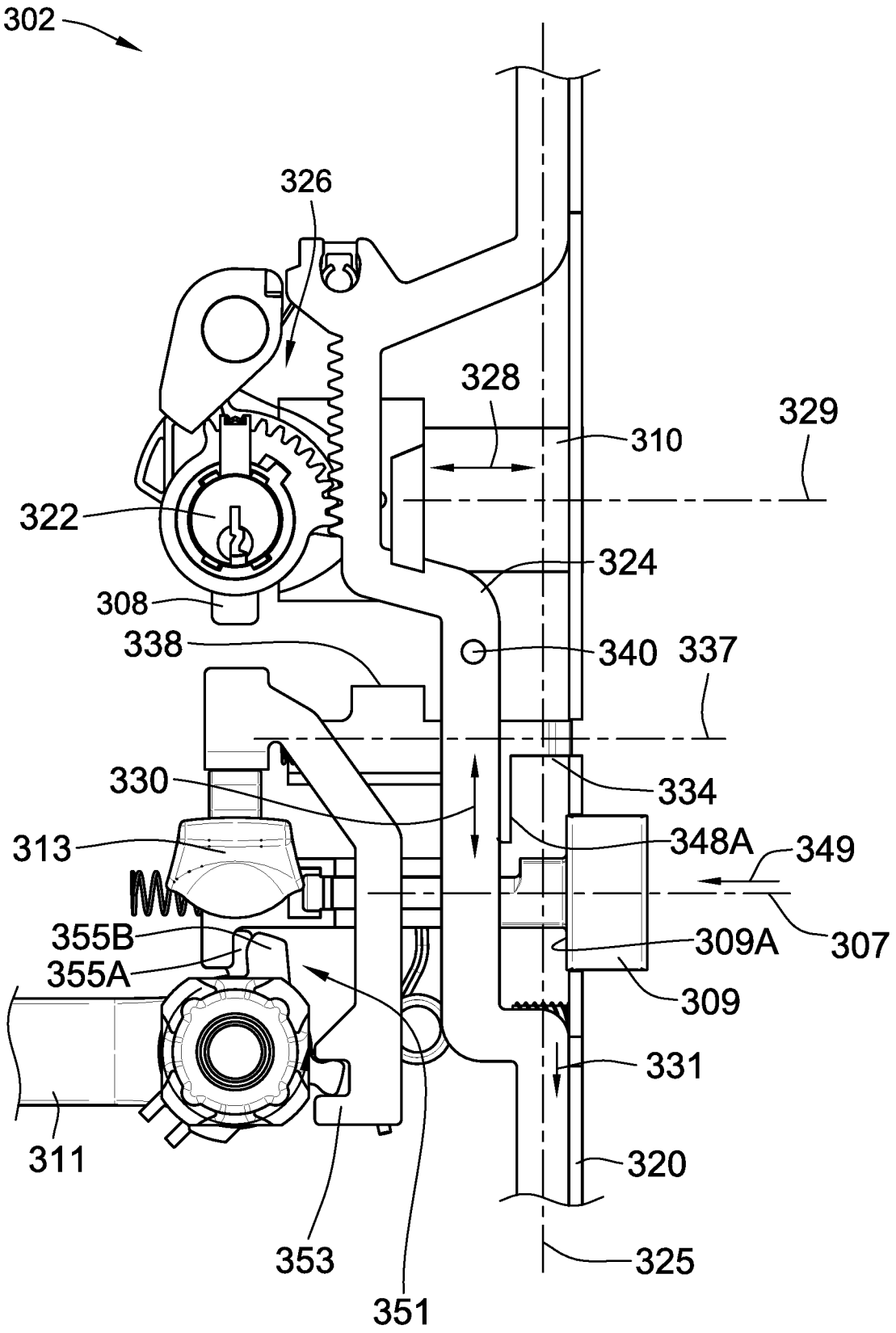
FIG. 20 is a simplified partial illustration of the embodiment of FIG. 16 with the deadbolt retracted and the lockout device in a released state.
Figure 21:
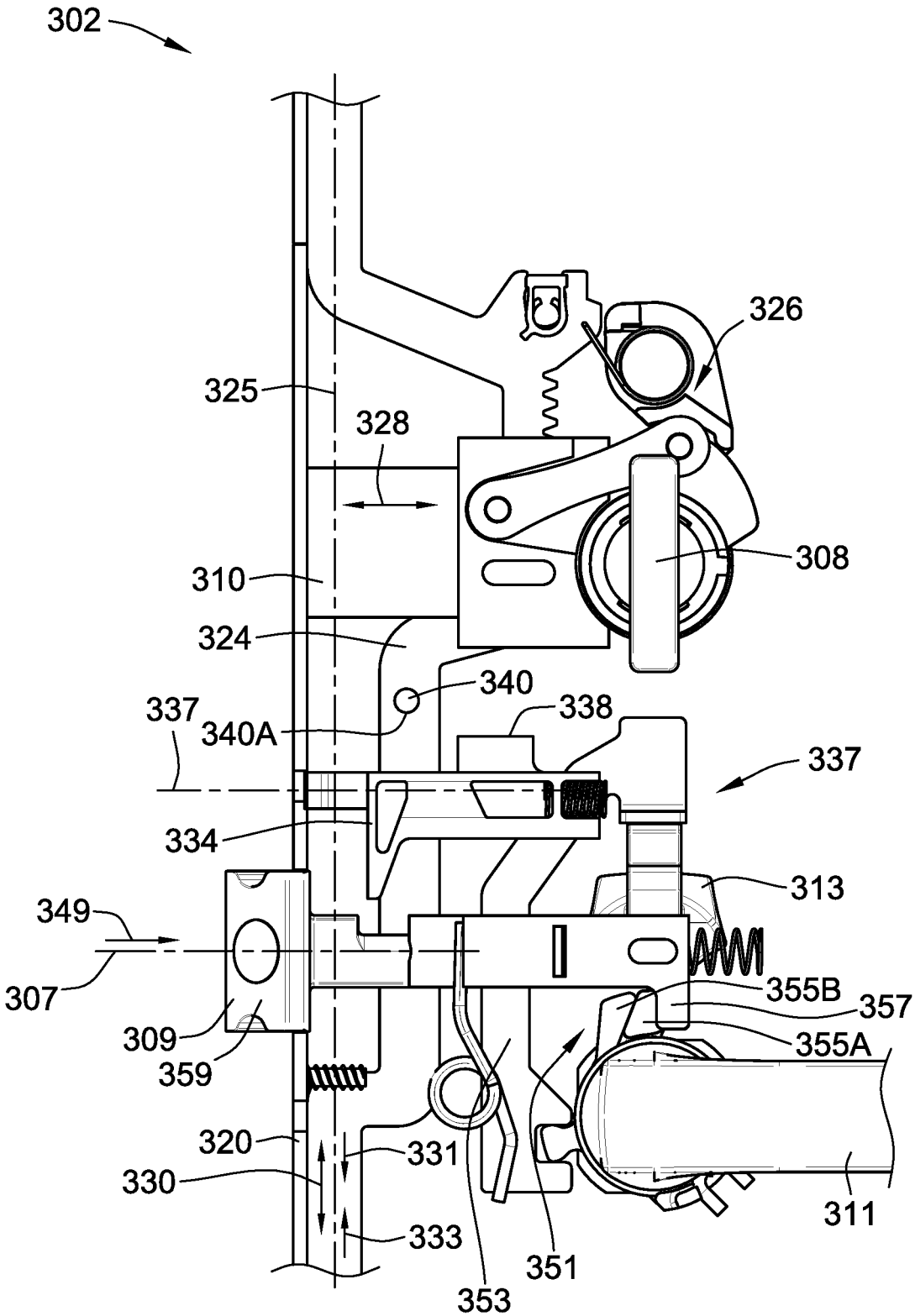
FIG. 21 is similar to FIG. 20 but viewed from the opposite side.

The lockout device 334 includes a contact end 342 that is configured to contact a strike plate 144 (FIG. 1) or other portion of the secondary door component 106 (e.g. a door jamb) when the hinged panel 104 is in a closed position. While it is typically understood that the strike plate is a separate component secured to the doorjamb, for simplicity of explanation, the door jamb or strike plate may be referred to generically as a strike plate. When the contact end 342 contacts the strike plate 144, the lockout device 334 is depressed, as illustrated by arrow 336 (FIGS. 16-19) along a lockout device axis 337, which causes the abutment 338 be moved laterally out of the way of projection 340 so that abutment 340A will not engage abutment 338 which transitions the lockout device 334 from the lockout state (FIG. 18) to the released state (FIGS. 20 and 21). With the lockout device 334 depressed, the abutments 338, 340A will no longer engage or cooperate with one another. Thus, once the lockout device 334 is depressed, the lock point actuation slide 324 is freed to slide along the lock point actuation slide axis 325. With the lock point actuation slide 324 free to slide, the thumb turn 308 or keyed lock cylinder 322 are likewise free to be actuated to transition the deadbolt 310 and auxiliary lock bolts to their extended states and to lock the hinged panel 104 relative to the secondary door component 106. It is noted that the lockout device axis 337 and lock point actuation slide axis 325 are transverse to one another and ideally perpendicular to one another. The relative orientations of these axes of motion allow for the lockout device 334 to be moved to prevent the lockout device 334 from interfering with the motion of the lock point actuation slide 324 and consequently preventing the lockout device 334 from preventing transitioning to a locked state.

As noted previously, strike plate 144 may be the same strike plate that defines an opening for receiving the deadbolt 110 or a separate strike plate or a portion of the secondary door component as mentioned above.

The lockout device 334, when in the lockout state, prevents actuation of the deadbolt 310 and the auxiliary lock bolts. This protects the secondary door component 106 as well as the multi-point locking arrangement from damage to a user trying to close the hinged panel 104 relative to the secondary door component 106 with the deadbolt 310 and auxiliary lock bolts in an extended state.

The lockout device 334 is spring biased toward the extended position illustrated in FIG. 16 by biasing spring 346. In the illustrated embodiment, the lockout device 334 is slidably carried by a frame of the lock mechanism.

Figure 22:
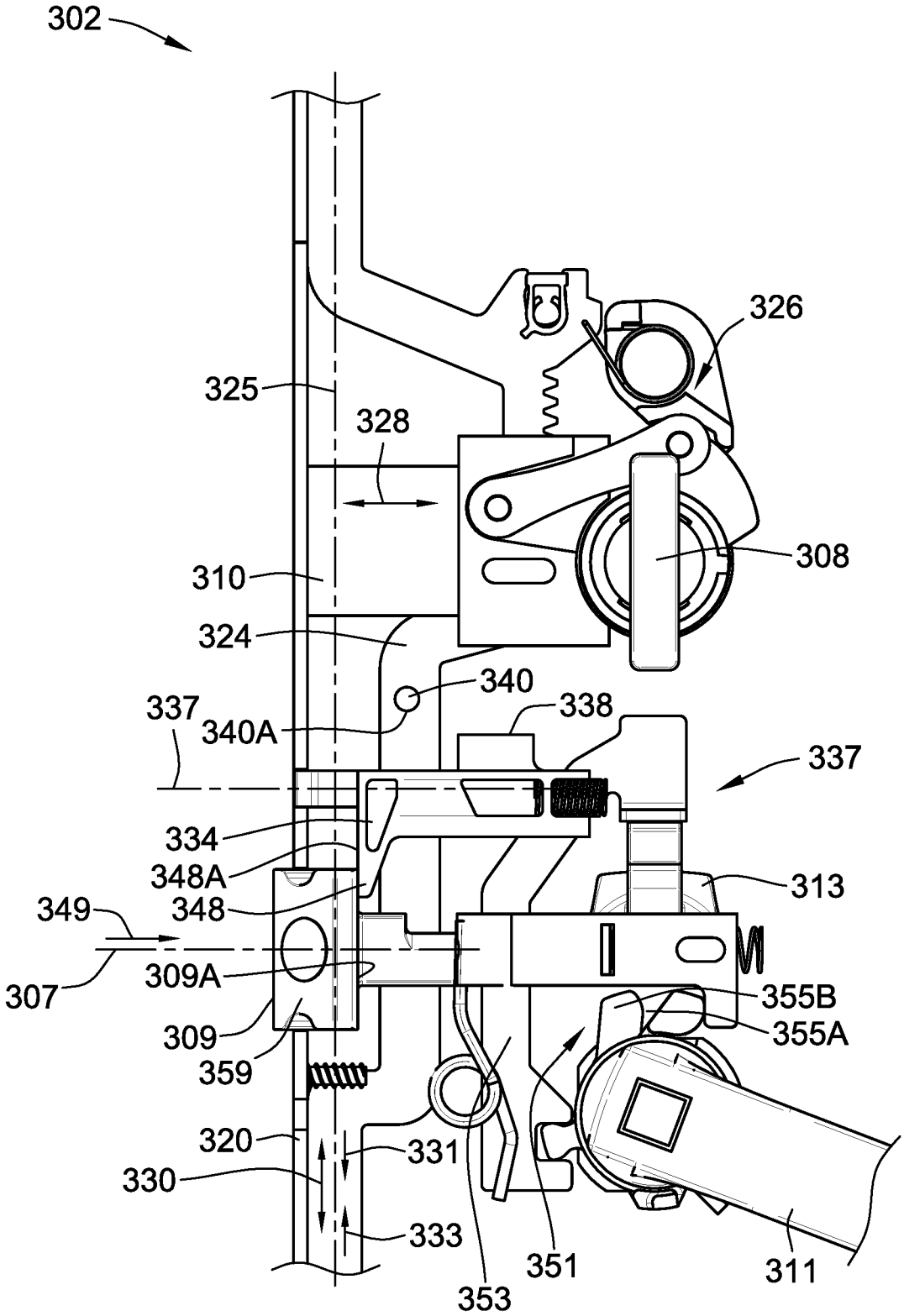
FIG. 22 is similar to FIG. 21 but with the latch retracted actuating the lockout device to the released state.
Figure 23:
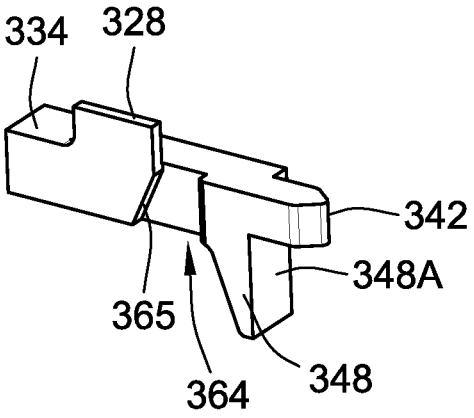
FIG. 23 is a perspective view of the lockout device removed from the rest of the multi-point locking arrangement.
Figure 24:
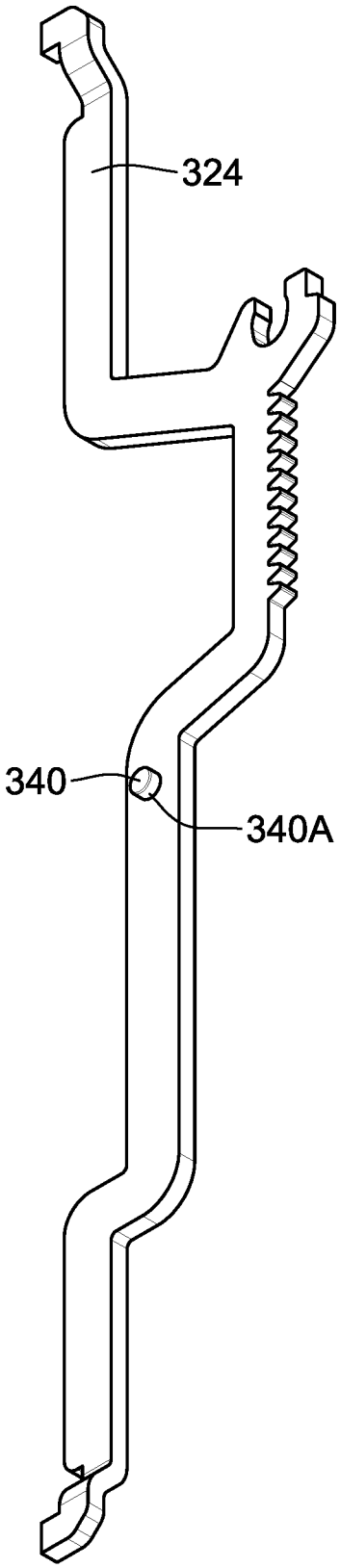
FIG. 24 is a perspective view of the lock point actuation slide removed from the rest of the multi-point locking arrangement.

In this embodiment, the handle 311 (see FIG. 16) or thumb piece 313 are operably coupled to latch 309 to drive the latch 309 linearly along a latch axis 307 between a latched state (see FIGS. 16-21) and an unlatched state (FIG. 22). In the unlatched state, the latch 309 is retracted relative to the edge of the hinged panel (illustrated by arrow 349).

The lockout device 334 and latch 309 include corresponding abutments 348A and 309A (identified in FIG. 20) that can engage one another if the lockout device 334 is in the lockout state and the latch 309 is transitioned from the latched state to the unlatched state. As the handle 311 or thumb piece 313 drives the latch 309 inward as illustrated by arrow 349 the latch 309 and particularly abutment 309A will engage abutment 348A and retract the lockout device 334 (illustrated by arrow 336) and transition the lockout device 334 to the released state. This allows a user to transition the multi-point locking arrangement 302 and particularly the deadbolt 310 and auxiliary lock bolts from the retracted state to the extended state by manually rotating thumb turn 308 or keyed lock cylinder 322. Alternatively, a user can manually depress the lockout device 334 by pressing on contact end 342.

Another benefit of having the latch 309 able to cooperate with and depress the lockout device 334 is that as the hinged panel 104 is swinging closed the contact end 342 of the lockout device 334 does not contact the strike plate or jamb until the latch 309 is received in the corresponding hole of the strike plate 144. This prevents the lockout device 334 from sliding on the strike plate or door jamb preventing wear of the lockout device or visible scratching or wear on the strike plate 144 or doorjamb. Thus, the latch 309 is preferably sized and configured to contact the strike plate 144 or jamb and begin to actuate the lockout device 334 before the lockout device 334 contacts the strike plate 144 or jamb. Only after the latch is aligned with and extends back outward to be received into the hole of the strike plate or jamb does the free end 342 abut the strike plate 144 or jamb. However, because the jamb or strike plate 144 does not have a corresponding hole or recess for the contact end 342 of the lockout device 334, the lockout device stays recessed and in the released state such that the multi-point lock 302 can be transitioned to the locked/extended state. It shall be noted that is a preferred arrangement, but other arrangements may not require this configuration and the lock out device 334 can contact the strike plate 144 or jamb as the hinged panel 104 closes.

Handle 311 and thumb piece 313 are operably coupled to a rotational actuation mechanism 351 that operably drives the latch 309 to retract the latch 309 when rotated. Thumb piece 313 is linked to the actuation mechanism 351 by link 353 (see FIG. 20) while handle 311 has a component that extends axially through and rotationally engages square bore 355 (see FIG. 22). Rotation of corresponding components of the rotational actuation mechanism 351 causes one or more of fingers 355A, 355B to press on projection 357 (see FIG. 22) operably connected to latch 309 to retract the latch 309.

Unlike the lock bolts, e.g. deadbolt 310 and auxiliary lock bolts, the latch 309 is spring loaded and has a tapered face 359 (see FIGS. 16, 18, 21) that allows the latch 309 to be retracted when contacting a strike plate or similar component of the secondary door component 106. Thus, the latch 309 will not be damaged if it is extended while the hinged panel is in an open position and is then closed.

The lockout device 334 is configured such that it extends laterally outward from the lateral edge of the hinged panel or cover 120 a first extent in the lockout state and a second lesser extent (which may include being fully depressed or recessed) in the released state.

To allow the lockout device 334 to transition to the released state from the locked or extended state by manipulation of the thumb turn 308 or lock cylinder 322 when the lock mechanism is in a locked state, see e.g. FIG. 16, the lockout device 334 defines a tapered abutment surface 365 (see e.g. FIG. 23) that will be contacted by an opposite side of the projection 340 as abutment 340A if the lock point actuation slide 324 is driven in the direction of arrow 333 in FIG. 16 when in the state illustrated in FIG. 16. The tapered abutment surface 365 will drive the lockout device 334 inward toward the released state and allow the projection 340 to pass by the portion of the lockout device 334 that defines abutment 338. This situation could occur if the hinged panel 104 is an open state, such as illustrated in FIG. 1, and the multi-point lock arrangement 302 is in the locked state but a user would like to transition the multi-point lock arrangement 302 to the unlocked or retracted state.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A multi-point locking arrangement comprising:

a primary lock bolt;

a first auxiliary lock bolt spaced from the primary lock bolt;

a lock mechanism including a rotational input device operably coupled to the primary lock bolt and first auxiliary lock bolt to drive the primary lock bolt and first auxiliary lock bolt when rotated, the rotational input device rotatable between a locked state and an unlocked state, in the locked state, the primary lock bolt and first auxiliary lock bolt are extended and, in the unlocked state, the primary lock bolt and first auxiliary lock bolt are retracted;

a lockout device transitionable between a released state and a lockout state, in the lockout state, the lockout device cooperates with the lock mechanism to prevent transitioning the rotational input device from the unlocked state to the locked state, in the released state, the lockout device permits the lock mechanism to transition the rotational input device from the unlocked state to the locked state, the lockout device configured to transition from the lockout state to the released state when the lockout device is depressed, a handle;

a latch operably coupled to the handle, the latch being driveable from a latched state to an unlatched state by operation of the handle; and wherein operation of the handle to drive the latch from the latched state to the unlatched state is operable to depress the lockout device and drive the lockout device from the lockout state to the released state.

2. The multi-point locking arrangement of claim 1, wherein the lockout device contacts a lockout device strike plate to be carried by or forming part of a secondary door component to transition the lockout device to the released state;

wherein when the lockout device no longer contacts the lockout device strike plate, the lockout device transitions to the lockout state.

3. The multi-point locking arrangement of claim 1, wherein actuation of only the rotational input device is required to actuate and extend the primary lock bolt and first auxiliary lock bolt when the lockout device is depressed and manipulation of a handle that controls a latch need not be actuated.

4. The multi-point locking arrangement of claim 1, wherein the rotational input device is in the form of a thumb turn.

5. The multi-point locking arrangement of claim 1, wherein the rotational input device is in the form of a keyed lock cylinder.

6. The multi-point locking arrangement of claim 1, wherein the lockout device travels linearly along a lockout device axis, the lockout device being depressable along the lockout device axis; the lockout device includes a first catch component defining a first abutment;

wherein the lock mechanism includes a lock point actuation slide operably interposed between the rotational input device and at least one of the primary lock bolt and first auxiliary lock bolt, the lock point actuation slide travels linearly along a lock point actuation slide axis between the unlocked state and the locked state, the lock point actuation slide includes a second catch component defining a second abutment;

the first and second abutments interfere with one another when the lock mechanism is in the unlocked state and the lockout device is in the lockout state preventing movement of the lock point actuation slide along the lock point actuation slide axis.

7. The multi-point locking arrangement of claim 6, wherein the latch travels along a latch axis as it transitions between the latched state and the unlatched state, the latch axis is generally parallel to and offset from the lockout device axis;

the lockout device has a third abutment;

the latch has a fourth abutment;

wherein the fourth abutment contacts the third abutment to drive the lockout device from the lockout state to the released state using the handle.

8. The multi-point locking arrangement of claim 6, further comprising:

the latch operably driveable from a latched state to an unlatched state by pressing on a tapered surface of the latch;

transitioning the latch from the latched state to the unlatched state is operable to depress the lockout device and drive the lockout device from the lockout state to the released state.

9. The multi-point locking arrangement of claim 6, wherein the latch travels along a latch axis as it transitions between the latched state and the unlatched state, the latch axis is generally parallel to and offset from the lockout device axis;

the lockout device has a third abutment;

the latch has a fourth abutment;

wherein the fourth abutment contacts the third abutment to drive the lockout device from the lockout state to the released state due to actuation of the latch.

10. A door arrangement comprising:

a locking arrangement according to claim 1;

a hinged panel carrying:

the primary lock bolt;

the first auxiliary lock bolt;

the lock mechanism;

the lockout device;

a secondary door component carrying:

a primary strike plate defining an opening receiving the primary lock bolt in the extended state when the hinged panel is in a closed position relative to the secondary door component;

a first auxiliary strike plate defining an opening receiving the first auxiliary bolt in the extended state when the hinged panel is in a closed position relative to the secondary door component; and a lockout device strike plate, the lockout device contacting the lockout device strike plate when the hinged panel is in a closed position relative to the secondary door component to transition the lockout device to the released state and, when the hinged panel transitions from the closed position relative to the secondary door component such that the lockout device no longer contacts the strike plate, the lockout device transitions to the lockout state.

11. The door arrangement of claim 10, wherein when extended, the primary lock bolt and first auxiliary lock bolt extend a first distance from a lateral edge of the hinged panel and wherein when retracted, the primary lock bolt and first auxiliary lock bolt extend a second lesser distance from a lateral edge of the hinged panel or are recessed below the lateral edge of the hinged panel.

12. The door arrangement of claim 10, wherein the lockout device contacts a lockout device strike plate to be carried by or formed by a secondary door component to transition the lockout device to the released state and, when the lockout device no longer contacts the lockout device strike plate, the lockout device transitions to the lockout state.

13. The multi-point locking arrangement of claim 1, wherein the rotational input device is rotatable between the locked state and unlocked state without requiring manipulation of a secondary component.

14. The multi-point locking arrangement of claim 13, wherein the rotational input device is one of a thumb turn or a keyed lock cylinder.

15. A multi-point locking arrangement comprising:

a primary lock bolt;

a first auxiliary lock bolt spaced from the primary lock bolt;

a lock mechanism including a rotational input device operably coupled to the primary lock bolt and first auxiliary lock bolt, the rotational input device rotatable between a locked state and an unlocked state, in the locked state, the primary lock bolt and first auxiliary lock bolt are extended and, in the unlocked state, the primary lock bolt and first auxiliary lock bolt are retracted; and a biasing auxiliary strike plate including an opening through which the first auxiliary lock bolt extends when the lock mechanism is in the locked state, the biasing auxiliary strike plate including a biasing mechanism for biasing the first auxiliary lock bolt in a direction transverse to a plane in which the first auxiliary lock bolt transitions as it transitions between the retracted and extended states and through the opening, the biasing mechanism being a spring biased roller including a pin and a roller carried on the pin, a first spring acting on a first end of the pin and a second spring acting on a second end of the pin, the roller being positioned between the first and second ends of the pin and the pair of springs, the springs biasing the pin and roller in the direction transverse to the plane in which the first auxiliary lock bolt transitions between the retracted and extended states.

16. The locking arrangement of claim 15, wherein the biasing mechanism extends across the opening a first extent when the first auxiliary lock bolt is removed from the opening and a second lesser extent when the first auxiliary lock bolt extends through the opening.

17. The locking arrangement of claim 15, further comprising a primary strike plate including an opening through which the primary lock bolt extends when the lock mechanism is in the locked state.

18. A door arrangement comprising:

a locking arrangement according to claim 15;

a hinged panel carrying:

the primary lock bolt; and the first auxiliary lock bolt;

a secondary door component carrying the biasing auxiliary strike plate such that receipt of the first auxiliary lock bolt into the opening of the biasing auxiliary strike plate locks the hinged panel to the secondary door component.

19. The door arrangement of claim 18, wherein the secondary door component is a door jamb.

20. The door arrangement of claim 18, wherein the secondary door component is a second hinged panel.

21. The door arrangement of claim 19, wherein the door jamb includes weather stripping against which the hinged panel is pressed when the hinged panel is in a closed state, the biasing mechanism biasing the first auxiliary lock bolt and the hinged panel toward the weather stripping.

* * * * *